US011259593B2

(12) United States Patent
Amoako et al.

(10) Patent No.: US 11,259,593 B2
(45) Date of Patent: Mar. 1, 2022

(54) SOLE STRUCTURE WITH TIERED PLATE ASSEMBLY FOR AN ARTICLE OF FOOTWEAR

(71) Applicant: NIKE, Inc., Beaverton, OR (US)

(72) Inventors: Lawrence K. Amoako, Portland, OR (US); Melusine Dieudonne, Portland, OR (US); Tim Steffen Schulze, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 230 days.

(21) Appl. No.: 16/527,282

(22) Filed: Jul. 31, 2019

(65) Prior Publication Data

US 2021/0030112 A1 Feb. 4, 2021

(51) Int. Cl.
*A43B 13/20* (2006.01)
*A43B 13/18* (2006.01)

(52) U.S. Cl.
CPC ..... *A43B 13/20* (2013.01); *A43B 13/186* (2013.01)

(58) Field of Classification Search
CPC ..... A43B 13/181; A43B 13/185; A43B 21/28
See application file for complete search history.

(56) References Cited

U.S. PATENT DOCUMENTS 4,592,153 A * 6/1986 Jacinto ..... A43B 21/30 36/27
4,771,554 A 9/1988 Hannemann
5,528,842 A 6/1996 Ricci et al.
6,898,870 B1 5/2005 Rohde
7,360,324 B2 * 4/2008 Aveni ..... A43B 1/0072 36/27
8,584,377 B2 * 11/2013 Blevens ..... A43B 13/223 36/25 R
9,241,535 B2 1/2016 Baudouin et al.
10,149,513 B1 12/2018 Eldem et al.
2003/0172548 A1 9/2003 Fuerst
2004/0221483 A1 11/2004 Cartier et al.
2005/0102857 A1 5/2005 Yen
2005/0102858 A1 5/2005 Yen
2005/0102859 A1 5/2005 Yen
2005/0108897 A1 * 5/2005 Aveni ..... A43B 13/183 36/27
2006/0010715 A1 * 1/2006 Tseng ..... A43B 13/10 36/11.5

(Continued)

FOREIGN PATENT DOCUMENTS

KR 101726729 B1 4/2017

*Primary Examiner* — Jila M Mohandesi
(74) *Attorney, Agent, or Firm* — Quinn IP Law

(57) ABSTRACT

A sole structure may have a tiered plate assembly including a first plate and a second plate. The first plate may extend from a forefoot region of the sole structure to a heel region of the sole structure. Stated differently, the first plate may be a full-length plate that extends the full length of the sole structure. The second plate may be joined with the first plate in a midfoot region of the sole structure and at a rear of a heel region of the sole structure, and may diverge from the first plate between the midfoot region and the rear of the heel region to define a first heel gap between the first plate and the second plate in the heel region. Heel cushioning units may be stacked in the heel region, with a first heel cushioning unit disposed in the first heel gap.

17 Claims, 12 Drawing Sheets

(56) References Cited

U.S. PATENT DOCUMENTS

| | | | | |
|---|---|---|---|---|
| 2006/0130362 | A1* | 6/2006 | Juan | A43B 7/142 36/27 |
| 2009/0100709 | A1 | 4/2009 | Macey et al. | |
| 2010/0107444 | A1* | 5/2010 | Aveni | A43B 13/206 36/88 |
| 2013/0031804 | A1 | 2/2013 | Abshire | |
| 2013/0125421 | A1 | 5/2013 | Stegmaier et al. | |
| 2014/0068969 | A1 | 3/2014 | Blevens et al. | |
| 2014/0075779 | A1* | 3/2014 | Bruce | A43B 13/20 36/29 |
| 2014/0259747 | A1 | 9/2014 | Baudouin et al. | |
| 2015/0027000 | A1 | 1/2015 | Barnes et al. | |
| 2016/0120262 | A1* | 5/2016 | Cortez | A43B 13/12 12/146 B |
| 2017/0095033 | A1 | 4/2017 | Farina et al. | |
| 2017/0095034 | A1 | 4/2017 | Dupre et al. | |
| 2018/0213886 | A1 | 8/2018 | Connell et al. | |
| 2018/0338577 | A1 | 11/2018 | Elder et al. | |

* cited by examiner

SOLE STRUCTURE WITH TIERED PLATE ASSEMBLY FOR AN ARTICLE OF FOOTWEAR

TECHNICAL FIELD

The present disclosure generally relates to a sole structure for an article of footwear.

BACKGROUND

Footwear typically includes a sole structure configured to be located under a wearer's foot to space the foot away from the ground. Sole structures may typically be configured to provide one or more of cushioning, motion control, and resiliency.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
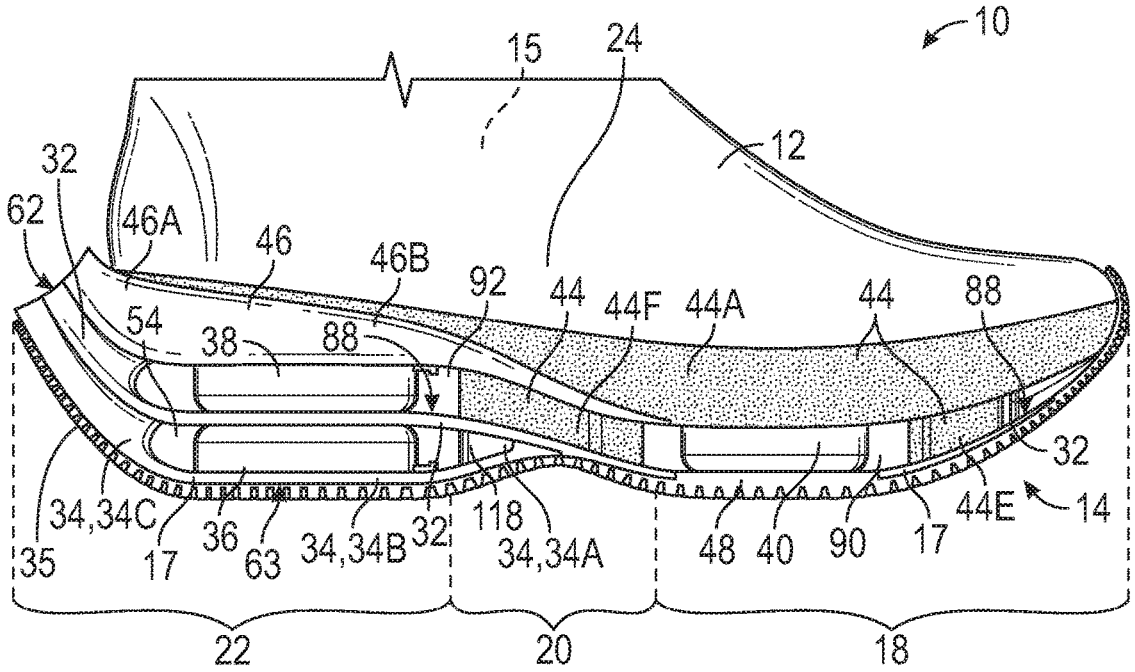
FIG. 1 is a lateral side view of an article of footwear with a sole structure that includes a tiered plate assembly and showing an upper in fragmentary view.

The present disclosure generally relates to a sole structure for an article of footwear that has a tiered plate assembly configured to provide stability, disperse dynamic loading forces over cushioning units disposed in the sole structure, maximizing the cushioning and energy return of the cushioning units. Additionally, the tiered nature enables a stacked cushioning arrangement in the heel region.

In an example, a sole structure may have a tiered plate assembly including a first plate and a second plate. The first plate may extend from a forefoot region of the sole structure to a heel region of the sole structure. Stated differently, the first plate may be a full-length plate that extends the full length of the sole structure. The second plate may be joined with the first plate in a midfoot region of the sole structure and at a rear of a heel region of the sole structure, and may diverge from the first plate between the midfoot region and the rear of the heel region to define a first heel gap between the first plate and the second plate in the heel region. For example, a forward portion and a rear portion of the second plate may both be joined to the distal side of the first plate with the first heel gap disposed between the forward portion and the rear portion of the second plate at a proximal side of the second plate and a distal side of the first plate.

In one or more implementations, a first heel cushioning unit may be disposed in the first heel gap and may confront the distal side of the first plate and the proximal side of the second plate. A second heel cushioning unit may be stacked on the proximal side of the first plate in the heel region opposite from the first heel cushioning unit. For example, the first heel cushioning unit and the second heel cushioning unit may be fluid-filled bladders. In some implementations, a tether element may be connected to opposite inner surfaces of the bladder and may extend across an interior cavity of the bladder. The positions of the plate(s) above and/or below the fluid-filled bladder helps to disperse compression forces evenly over the area of the bladder having the tethers, enabling the tethers to slacken when the fluid-filled bladder is elastically deformed under compression, and return to a tensioned state in unison when the fluid-filled bladder returns the energy applied to elastically deform the bladder as the compression is relieved.

In one or more configurations, a rear portion of the first plate and the rear portion of the second plate may ascend together in a proximal direction at the rear of the heel region. This effectively creates a rounded profile of the sole structure at the rear of the heel region, encouraging a more gradual forward roll during a heel strike. Additionally, the rounded profile may allow a wearer to rest the rear of the sole structure at the rounded profile against the ground, with the forefoot region lifted from the ground contact surface, such as when the wearer is seated.

In an aspect, the rear portion of the first plate may define a first heel through hole, and the rear portion of the second plate may define a second heel through hole, with the second heel through hole in communication with the first heel through. Additionally, the heel through holes provide weight savings in comparison to a sole structure in which the plates do not have heel through holes. The heel through holes also allow the heel cushioning units to be viewed from a vantage point rearward of the sole structure.

In another aspect, the rear portion of the first plate may have a ledge, and the sole structure may further include a peripheral heel clip that has a rear segment supported on the ledge, a medial segment extending forward from the rear segment along a medial side of the sole structure, and a lateral segment extending forward from the rear segment along a lateral side of the sole structure, with the medial segment and the lateral segment spaced apart from the first plate.

In some implementations, a cushioning layer may extend from the forefoot region to the heel region and may contact the proximal side of the first plate at a front of the first plate in the forefoot region and at the midfoot region, with the cushioning layer defining a forefoot gap at a distal side of the cushioning layer between the front of the forefoot region and the midfoot region, and defining a second heel gap at the distal side of the cushioning layer rearward of the midfoot region. In an aspect, the rear segment of the peripheral heel clip may contact a rear wall of the cushioning layer and may be supported on a rear portion of the first plate, the medial segment of the peripheral heel clip may extend forward from the rear segment along a medial side wall of the cushioning layer, and the lateral segment of the peripheral heel clip may extend forward from the rear segment along a lateral side wall of the cushioning layer. The heel clip may be harder than the cushioning layer, increasing stability in the heel region.

In one or more configurations, the first plate may have a medial notch in a medial edge of the first plate in the forefoot region and a lateral notch in a lateral edge of the first plate in the forefoot region. The width of the first plate is decreased at the notches, which may increase medial-lateral flexibility in the forefoot region. Still further, the first plate may be bifurcated forward of the medial notch and the lateral notch, further increasing forefoot flexibility.

In an aspect, a medial forefoot cushioning unit may be disposed at the medial notch and a lateral forefoot cushioning unit may be disposed at the lateral notch alongside with medial forefoot cushioning unit. By disposing the forefoot cushioning units at the notches rather than on the first plate, the relatively stiff first plate does not disperse reactive forces over the forefoot cushioning units; instead, only less stiff components (e.g., the cushioning layer and the outsole) contact the forefoot cushioning units so that they are better able react separately to dynamic compression with their individual cushioning responses tailored to react medial or lateral forces. In one or more embodiments, either or both of the forefoot cushioning units may be fluid-filled bladders.

In an aspect, an outsole may be disposed at a distal side of the first plate in the forefoot region, and the distal sides of the medial forefoot cushioning unit and the lateral forefoot cushioning unit may contact the outsole. The outsole may be less stiff and not a hard as the first plate.

In a further aspect, the outsole may extend from the forefoot region to the heel region and may be disposed at the distal side of the second plate in the heel region. For example, at least one of the forefoot cushioning units may be disposed in the forefoot gap (e.g., between the cushioning layer and the outsole), and a heel cushioning unit (e.g., the second heel cushioning unit) may be disposed in the second heel gap.

In another example, an article of footwear may comprise an upper and a sole structure coupled to the upper. The sole structure may include the tiered plate assembly as described above.

The above features and advantages and other features and advantages of the present teachings are readily apparent from the following detailed description of the modes for carrying out the present teachings when taken in connection with the accompanying drawings.

Figure 4:
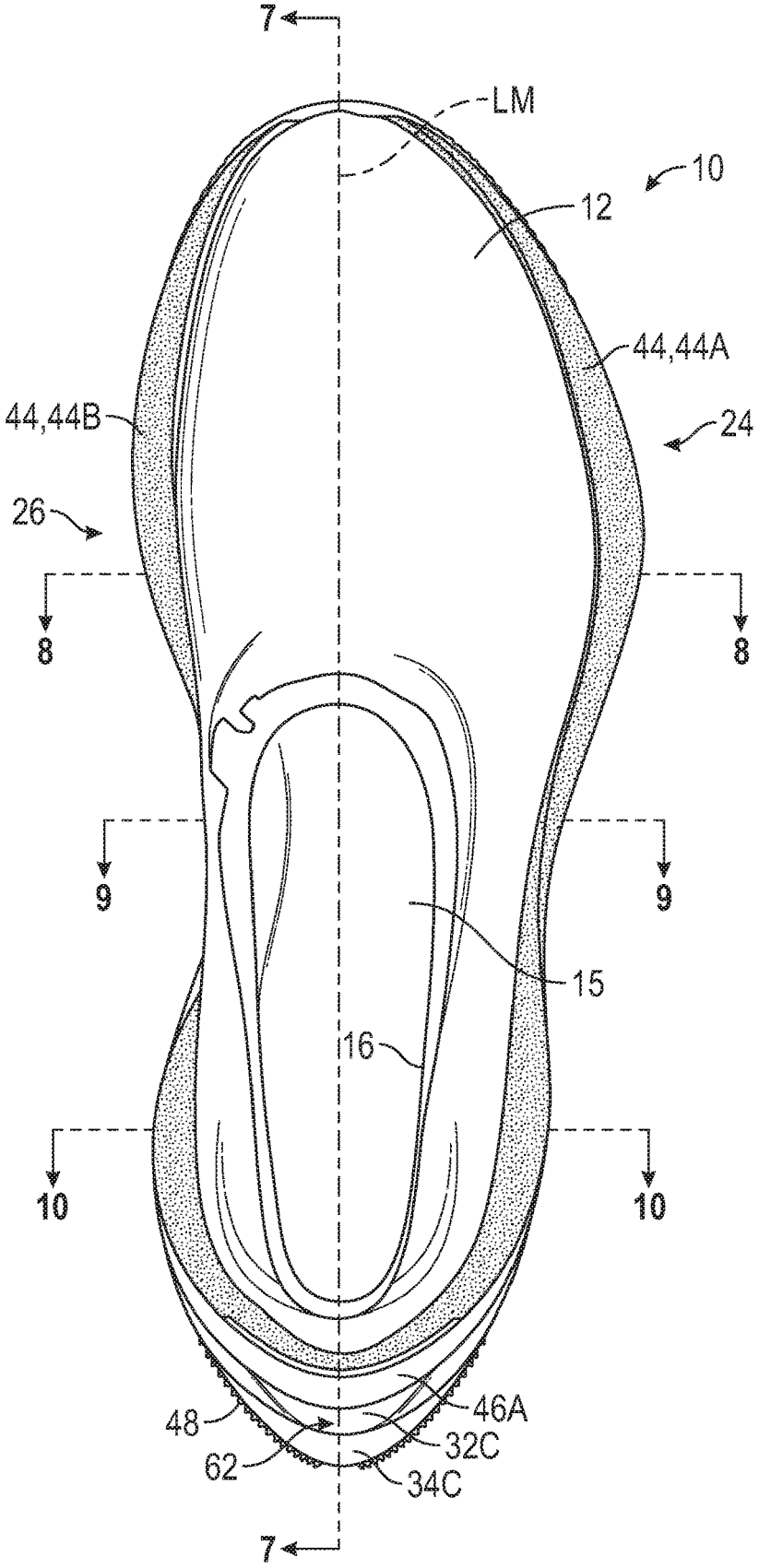
FIG. 4 is a top view of the article of footwear.

FIG. 1 shows an article of footwear 10 that includes an upper 12 and a sole structure 14 coupled to the upper 12 to define a void 15 (also referred to as a foot-receiving cavity) accessible through an ankle opening 16 (see FIG. 4). The sole structure 14 includes a tiered plate assembly 17 configured as described herein. The article of footwear 10 may be referred to as footwear 10, may be athletic footwear configured for sports such as basketball, or for various other sports such as but not limited to running, tennis, football, soccer, etc., or may instead be a leisure shoe, a dress shoe, a work shoe, a sandal, a slipper, a boot, or any other category of footwear.

The article of footwear 10 as well as the upper 12 and the sole structure 14 may be divided into a forefoot region 18, a midfoot region 20, and a heel region 22. The forefoot region 18 generally includes portions of the article of footwear 10 corresponding with the toes and the metatarsophalangeal joints (which may be referred to as MPT or MPJ joints) connecting the metatarsal bones of the foot and the proximal phalanges of the toes. The midfoot region 20 generally includes portions of the article of footwear 10 corresponding with the arch area and instep of the foot, and the heel region 22 corresponds with rear portions of the foot, including the calcaneus bone. The forefoot region 18, the midfoot region 20, and the heel region 22 are not intended to demarcate precise areas of the footwear 10 but are instead intended to represent general areas of the footwear 10 to aid in the following discussion.

Figure 2:
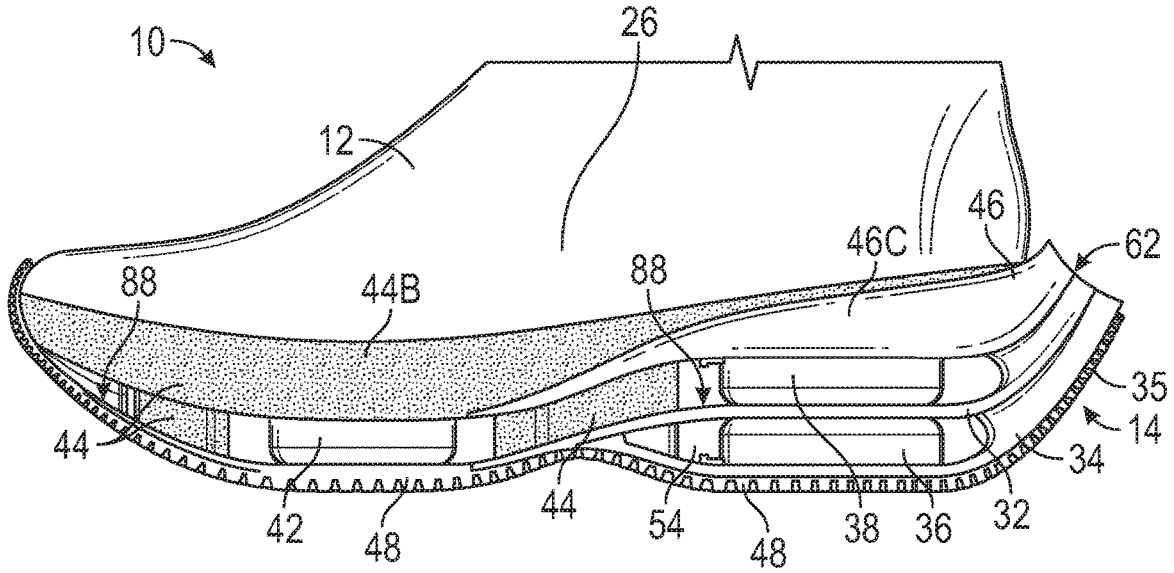
FIG. 2 is a medial side view of the article of footwear with the upper in fragmentary view.

The footwear 10 has a lateral side 24 (shown in FIG. 1) and a medial side 26 (shown in FIG. 2). The lateral side 24 and the medial side 26 extend through each of the forefoot region 18, the midfoot region 20, and the heel region 22, and correspond with opposite sides of the article of footwear 10, each falling on an opposite side of a longitudinal midline LM of the article of footwear 10, indicated in FIG. 4. The lateral side 24 is thus considered opposite to the medial side 26.

The upper 12 may be a variety of materials, such as leather, textiles, polymers, cotton, foam, composites, etc., or combinations of these. For example, the upper 12 may be a polymeric material capable of providing elasticity, and may be of a braided construction, a knitted (e.g., warp-knitted) construction, or a woven construction. A lower extent of the upper 12 is secured to a periphery of the sole structure 14 as shown in FIG. 1. The proximal surface 28 (e.g., the foot-facing surface) of the sole structure 14 in the interior void 15 (shown in FIG. 7) may be a strobel 31 secured to a lower region of the upper 12. Alternatively, the upper 12 may be a 360-degree sock-like upper that extends under the foot and establishes the proximal surface 28. An insole (not shown) may rest in the void 15 on the proximal surface 28.

Figure 3:
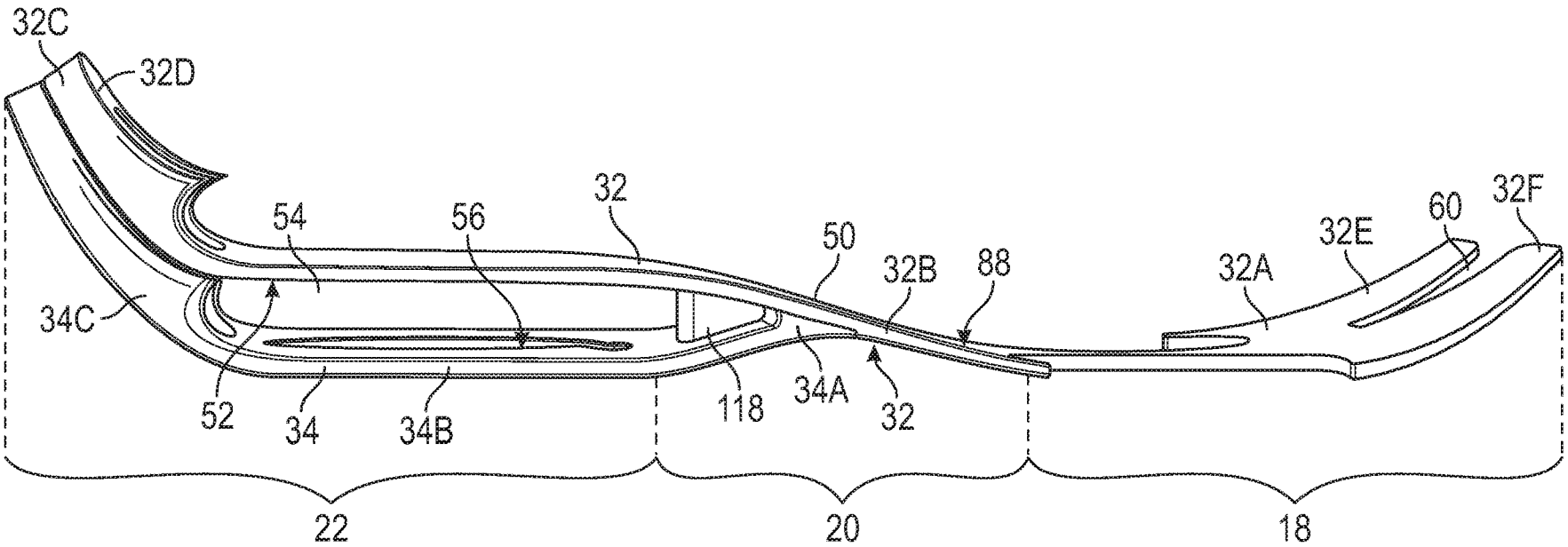
FIG. 3 is a slightly perspective lateral side view of the tiered plate assembly of the sole structure.

The tiered plate assembly 17 is shown in isolation in FIG. 3 and includes first and second plates 32, 34, which may also be referred to as sole plates. As discussed herein, the plates 32, 34 are uniquely configured to moderate forces applied to one or more cushioning units disposed between or adjacent to the plates 32, 34. As used herein, the term "plate", such as in the first plate 32 and the second plate 34, refers to a member of a sole structure that has a width greater than its thickness and is generally horizontally disposed when assembled in an article of footwear with the sole structure resting on a level ground surface, so that its thickness is generally in the vertical direction and its width is generally in the horizontal direction. Although each plate 32, 34 is shown as a single, unitary component, a plate need not be a single component but instead can be multiple interconnected components. Portions of a plate can be flat, and portions can have some amount of curvature and variations in thickness when molded or otherwise formed, for example, to provide a shaped footbed and/or increased thickness for reinforcement in desired areas.

As further explained herein and with reference to FIGS. 1 and 2, in addition to the tiered plate assembly 17 with the first plate 32 and the second plate 34, the sole structure 14 includes a first heel cushioning unit 36, a second heel cushioning unit 38, a lateral forefoot cushioning unit 40, a medial forefoot cushioning unit 42, a cushioning layer 44, a peripheral heel clip 46, and an outsole 48. As further discussed herein, the peripheral heel clip 46 has a rear segment 46A, a lateral segment 46B extending forward from the rear segment 46A along a lateral side wall 44A of the cushioning layer 44 (see FIG. 1), and a medial segment 46C extending forward from the rear segment 46A along a medial side wall 44B of the cushioning layer 44 (see FIG. 2).

Generally, each of the plates 32, 34 may be a relatively rigid material or combination of materials. For example, either or both of the plates 32, 34 may comprise a thermoplastic elastomer. In other examples, in one or more embodiments, either or both of the plates 32, 34 may comprise a carbon fiber, a carbon fiber composite (such as a carbon fiber-filled nylon), a fiberglass-reinforced nylon, which may be an injected, fiber-reinforced nylon, a fiber strand-lain composite, a thermoplastic polyurethane, wood, steel, or another material or combinations of these, but is not limited to these materials. In additional to their geometry, the materials selected for the first plate and the second plate may result in desired performance characteristics.

Like the plates 32, 34, the peripheral heel clip 46 may be relatively rigid, and may be one or more of any of the materials described with respect to the plates 32, 34. The peripheral heel clip 46 may provide side support for the cushioning layer 44 as described herein, which may be less rigid than the peripheral heel clip 46. Because the peripheral heel clip 46 may be harder than the cushioning layer 44, it may be easier to consistently produce the peripheral heel clip 46 to meet dimensional tolerances. By disposing the peripheral heel clip 46 at the outer surface of the cushioning layer 44 around the rear of the heel region 22, it may be easier to provide a flush upturned surface 62 comprised of the rear segment 46A of the heel clip 46, the rear portion 32C of the first plate 32, and the rear portion 34C of the second plate 34 that may be pushed against with the opposite foot to remove the article of footwear 10.

In one example, the peripheral heel clip 46 and the first plate 32 may be harder and less flexible than the second plate 34. For example, the peripheral heel clip 46 and the first plate 32 may both be the same material, such as the polyether block amide PEBAX Rnew 63R53 SP01, a thermoplastic elastomer made of flexible polyether and rigid polyamide based on renewable resources and having an instantaneous hardness of 58 on a Shore D durometer test scale using the ISO 868 test method, and available from Arkema, Inc. in King of Prussia, Pa. USA. The second plate 34 may be PEBAX® Rnew 55R53 SP0 1 also a thermoplastic elastomer made of flexible polyether and rigid polyamide based on renewable resources and having an instantaneous hardness of 50 on a Shore D durometer test scale using the ISO 868 test method and also and available from Arkema, Inc. in King of Prussia, Pa. USA.

In an embodiment, the cushioning layer 44 may be at least partially a polyurethane foam, or a polyurethane ethylene-vinyl acetate (EVA) foam and may include heat-expanded and molded EVA foam pellets. The cushioning layer 44 may generally include phylon (ethylene vinyl acetate or "EVA") and/or polyurethane ("PU") base resins. For example, in one embodiment, the cushioning layer 44 may be a compression molded phylon. If EVA is used, it may have a vinyl acetate (VA) level between approximately 9% and approximately 40%. Suitable EVA resins include Elvax®, provided by E. I. du Pont de Nemours and Company, and Engage™, provided by the Dow Chemical Company, for example. In certain embodiments, the EVA may be formed of a combination of high melt index and low melt index material. For example, the EVA may have a melt index of from about 1 to about 50. The EVA resin may be compounded to include various components including a blowing agent and a curing/cross-linking agent. The blowing agent may have a percent weight between approximately 10% and approximately 20%. The blowing agent may be thermally decomposable and is selected from ordinary organic and inorganic chemical blowing agents. The nature of the blowing agent is not particularly limited as long as it decomposes under the temperature conditions used in incorporating the foam into the virgin resin. Suitable blowing agents include azodicarboamide, for example. In certain embodiments, a peroxide-based curing agent, such as dicumyl peroxide may be used. The amount of curing agent may be between approximately 0.6% and approximately 1.5%. The EVA may also include homogenizing agents, process aids, and waxes. For example, a mixture of light aliphatic hydrocarbons such as Struktol® 60NS, available from Schill+Seilacher "Struktol" GmbH, may be included to permit other materials or scrap EVA to be more easily incorporated into the resin. The EVA may also include other constituents such as a release agent (e.g., stearic acid), activators (e.g., zinc oxide), fillers (e.g., magnesium carbonate), pigments, and clays. In embodiments that incorporate multiple materials, each material may be formed from a material that is compatible and readily bonds with the other material. For example, the materials may each be formed from an EVA resin with suitable blowing agents, crosslinking agents, and other ancillary components, pigments, fillers, and the like. Other suitable materials will become readily apparent to those skilled in the art, given the benefit of this disclosure.

The outsole 48 may be formed from materials that may generally include natural or synthetic rubber or other suitably durable materials. The material or materials for the outsole may be selected to provide a desirable combination of durability and flexibility. Synthetic rubbers that may be used include polybutadiene rubber, ethylene propylene rubber (EPR), styrene isoprene styrene (SIS) copolymer rubber, and styrene butadiene rubber. In some embodiments, the outsole 48 may be transparent or semi-transparent so that the forefoot cushioning units 40, 42 can be viewed from the bottom through the outsole 48.

With reference to FIG. 3, the first plate 32 extends from the forefoot region 18 of the sole structure 14 to the heel region 22 of the sole structure 14. The first plate 32 is a full-length plate that extends the full length of the sole structure 14. The first plate 32 is not planar in a profile view, and instead has an inflection 50 in a midportion 32B of the first plate 32 at the midfoot region 20 so that the heel region of the first plate 32 is disposed higher in the sole structure 14 than the forefoot region 18 of the first plate 32 when the sole structure 14 is oriented with the outsole 48 disposed on the ground and the upper 12 above the sole structure 14, as when worn with the user standing on the sole structure 14 in the position of FIGS. 1 and 2. A front portion 32A of the first plate 32 ascends in a forward and proximal direction (e.g., is upturned when the first plate 32 is in the position of FIGS. 1-3). Similarly, a rear portion 32C of the first plate 32 ascends in a rearward and proximal direction and is higher than the front portion 32A in the position of FIGS. 1-3. FIG. 3 also shows that the first plate 32 includes a ledge 32D at the rear portion 32C for supporting the peripheral heel clip 46 as further discussed herein. Additionally, the front portion 32A is bifurcated and includes a medial projection 32E and a lateral projection 32F separated from one another by a slot 60.

During dorsiflexion, as the heel region 22 lifts with the forefoot region 18 remaining in contact with the ground, the first plate 32 bends generally under a bending axis of the metatarsal phalangeal joints MTP which are generally over the forefoot cushioning units 40, 42, and the concavity of the proximal side 88 of the first plate 32 in the forefoot region 18 increases. The bending axis is generally transverse to the sole structure 14 and may be angled slightly forward on the medial side 26 relative to the lateral side 24 in accordance with the bones of the foot. The different MTP joints of the foot may have slightly different bending axes, and the position where the bending axis is disposed will vary depending on the specific foot. At toe off, when the foot lifts the sole structure 14 away from the ground, the compressive forces in the sole structure 14 above a neutral axis (i.e., toward the proximal side of components of the sole structure 14), and the tensile forces below the neutral axis (i.e., toward the distal side of components of the sole structure 14) are relieved, returning the first plate 32 from the dorsiflexed state of increased forefoot concavity to its unstressed state shown in FIGS. 1 and 2. At least a portion of the wearer's own energy input may be returned, as the internal compressive and tensile forces in the first plate 32, due to the wearer bending the first plate 32, are released as the first plate 32 unbends, which may create a net force at least partially in the forward direction. The slight spoon shape of the first plate 32 also helps the forward rolling of the foot during dorsiflexion to occur with less effort in comparison to a plate with a flat side profile.

The second plate 34 is not a full-length plate in the embodiment shown, but instead extends only in the midfoot region 20 and the heel region 22. More specifically, the second plate 34 has a forward portion 34A joined with a distal side 52 of the first plate 32 in the midfoot region 20. The second plate 34 has a rear portion 34C joined with the distal side 52 of the first plate 32 at a rear of the heel region 22. The second plate 34 has a midportion 34B between the forward portion 34A and the rear portion 34C. The midportion 34B diverges from the first plate 32 between the forward portion 34A and the rear portion 34C to define a first heel gap 54 between the distal side 52 of the first plate 32 and a proximal side 56 of the second plate 34 in the heel region 22. Stated differently, the midportion 34B is spaced apart from the first plate 32 by the first heel gap 54.

FIG. 4 shows a top view of the article of footwear 10. The cushioning layer 44 is relatively wide, extending outward of the upper 12 at the lateral side 24 and the medial side 26. At a rear extent of the article of footwear 10, the upturned, tiered plate assembly 17 and heel clip 46 are stacked, with the rear segment 46A of the heel clip 46 stacked on the rear portion 32C of the first plate 32, and the rear portion 32C of the first plate 32 stacked on the rear portion 34C of the second plate 34. Together, these stacked components are flush at an upturned surface 62 (also shown in FIGS. 1 and 2) that may be used as a heel bump at which the wearer's opposite foot can be leveraged to help remove the footwear 10.

Figure 5:
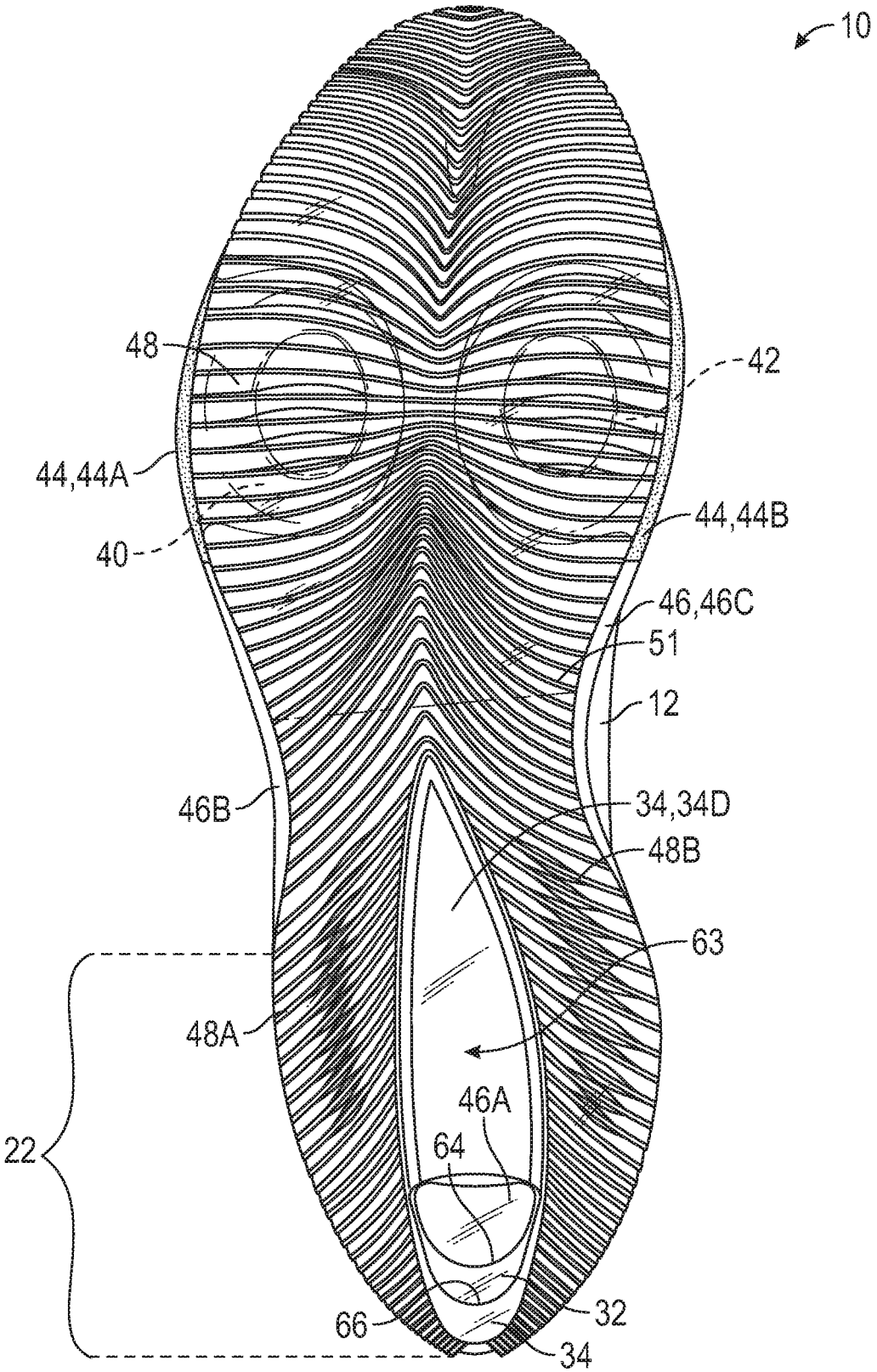
FIG. 5 is a bottom view of the article of footwear.

FIG. 5 is a bottom view of the article of footwear 10. The outsole 48 is shown as a unitary, one-piece outsole with integral tread elements 51 configured as wavy ribs arranged in a traction pattern. In other embodiments, the outsole 48 could be multiple discreet components and/or different tread elements could be arranged in a different traction pattern. The outsole 48 is depicted as at least partially transparent (e.g., transparent or semi-transparent) with the forefoot cushioning units 40, 42 viewable from the bottom through the outsole 48. The outsole 48 extends from the forefoot region 18 to the heel region 22 and is disposed at the distal side 63 of the second plate 34 in the heel region 22. The outsole 48 is bifurcated in the heel region 22 where it splits into a lateral side portion 48A and a medial side portion 48B. The distal side 63 of the second plate 34 is exposed between the side portions 48A, 48B. More specifically, a recess 34D in the distal side 63 is exposed and the lateral and medial side portion 48A, 48B line the distal side 63 of the second plate 34 on either side of the recess 34D. A first heel through hole 64 of the first plate 32 and a first heel through hole 66 of the second plate 34 are exposed between the side portions 48A, 48B and are in communication (e.g., are sufficiently aligned such that the through holes 64, 66 at least partially overlap one another).

Figure 6:
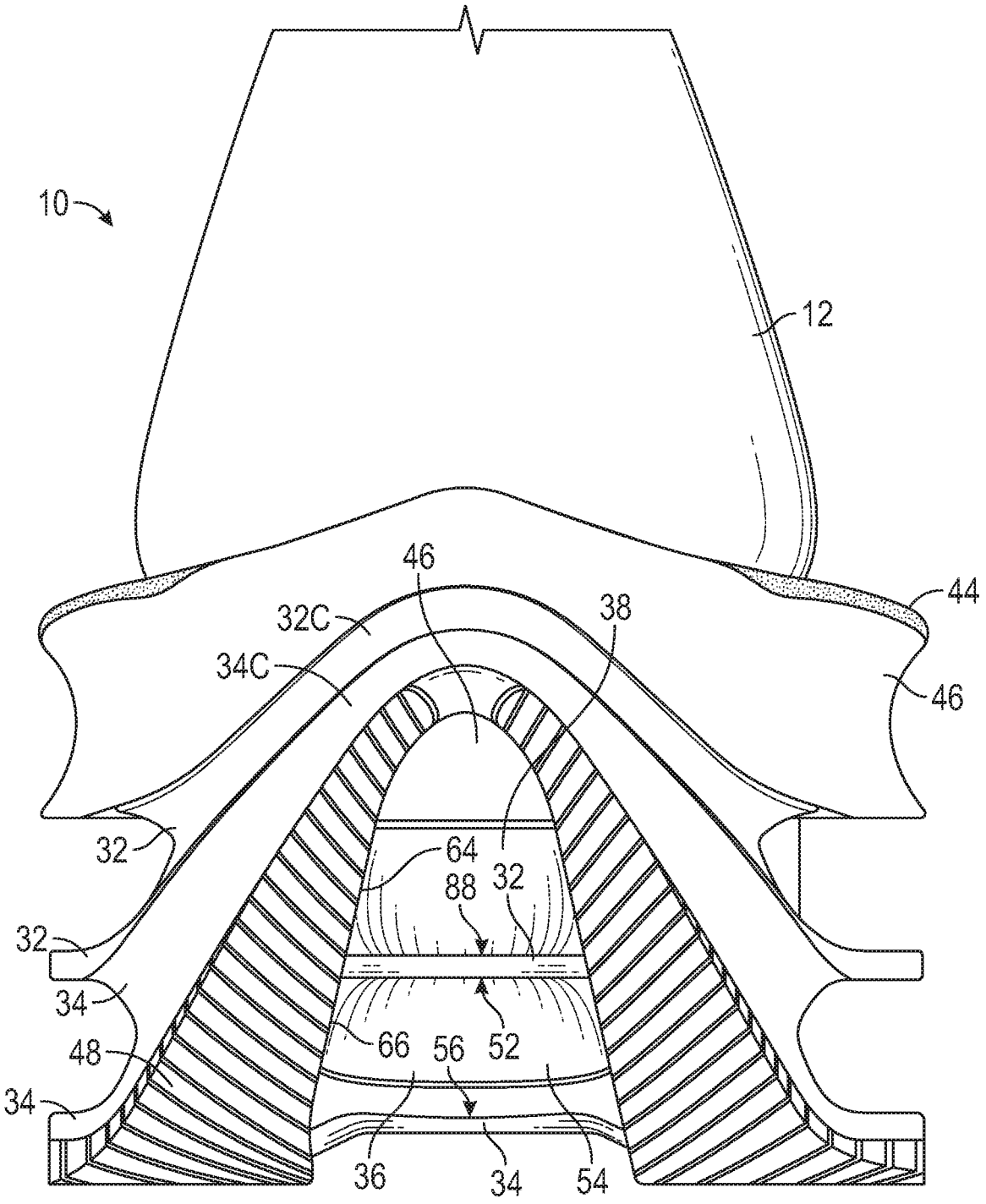
FIG. 6 is a rear view of the article of footwear with the upper in fragmentary view.

FIG. 6 is a rear view of the article of footwear 10 with the upper 12 in fragmentary view. The rear portion 32C of the first plate 32 and the rear portion 34C of the second plate 34 are shown ascending together in a proximal direction at the rear of the heel region creating the rounded profile 35 of the sole structure 14 at the rear of the heel region 22 evident in FIGS. 1 and 2 that encourages a more gradual forward roll during a heel strike than would a flatter profile. Additionally, the rounded profile 35 of the sole structure 14 at the rear of the heel region 22 allows the wearer to rest the sole structure 14 at the rounded profile 35 against the ground, with the forefoot region 18 and midfoot region 20 lifted away from the ground, such as when the wearer is seated.

The first heel cushioning unit 36 is disposed in the first heel gap 54 and contacts the distal side 52 of the first plate 32 and the proximal side 56 of the second plate 34. The second heel cushioning unit 38 is stacked on the proximal side 88 of the first plate 32 in the heel region 22 opposite from the first heel cushioning unit 36. As is clear in FIG. 6, The second heel through hole 66 is in communication with the first heel through hole 64 and with the first heel gap 54. The heel through holes 64, 66 thus allow the heel cushioning units 36, 38 to be viewed through the through holes 64, 66 from a vantage point at the rear of the sole structure 14 looking forward. The through holes 64, 66 provide a relatively large opening that may make cleaning dust or dirt on the heel cushioning units 36, 38 easier in comparison to cleaning through a narrow through hole.

Figure 7:
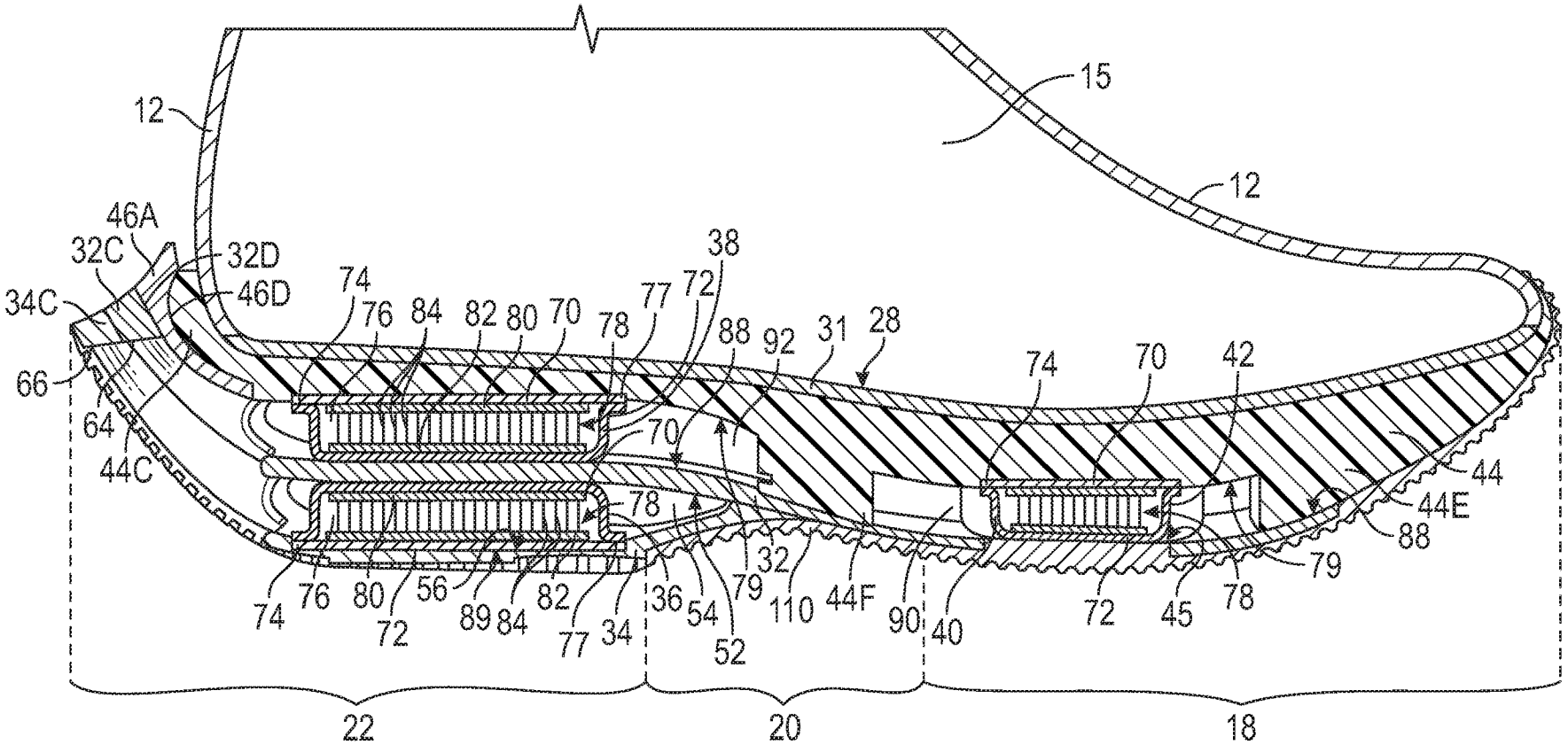
FIG. 7 is a cross-sectional view of the article of footwear taken at lines 7-7 in FIG. 4 with the upper in fragmentary view.

FIG. 7 is a cross-sectional view of the article of footwear 10 taken at lines 7-7 in FIG. 4 with the upper 12 in fragmentary view. The cross-section of FIG. 7 extends through part of the medial forefoot cushioning unit 42 and through the first and second heel cushioning units 36, 38. In the embodiment shown, each of the lateral forefoot cushioning unit 40, the medial forefoot cushioning unit 42, the first heel cushioning unit 36 and the second heel cushioning unit 38 is a fluid-filled bladder, sometimes referred to as a fluid-filled chamber, a bladder element, or an airbag, and may be referred to as such for clarity in the description. As used herein, a "fluid" filling the interior cavity 76 of each such fluid-filled bladder may be a gas, such as air, nitrogen, another gas, or a combination thereof. Within the scope of the disclosure, however, any one or more of the lateral forefoot cushioning unit 40, the medial forefoot cushioning unit 42, the first heel cushioning unit 36 and the second heel cushioning unit 38 could be foam structures, or other resilient materials rather than fluid-filled bladders. In the embodiment shown, the heel cushioning units 36, 38 are the same size as one another (e.g., have the same sealed internal volume) and are larger than the forefoot cushioning units 40, 42 which are the same size as one another.

Figure 8:
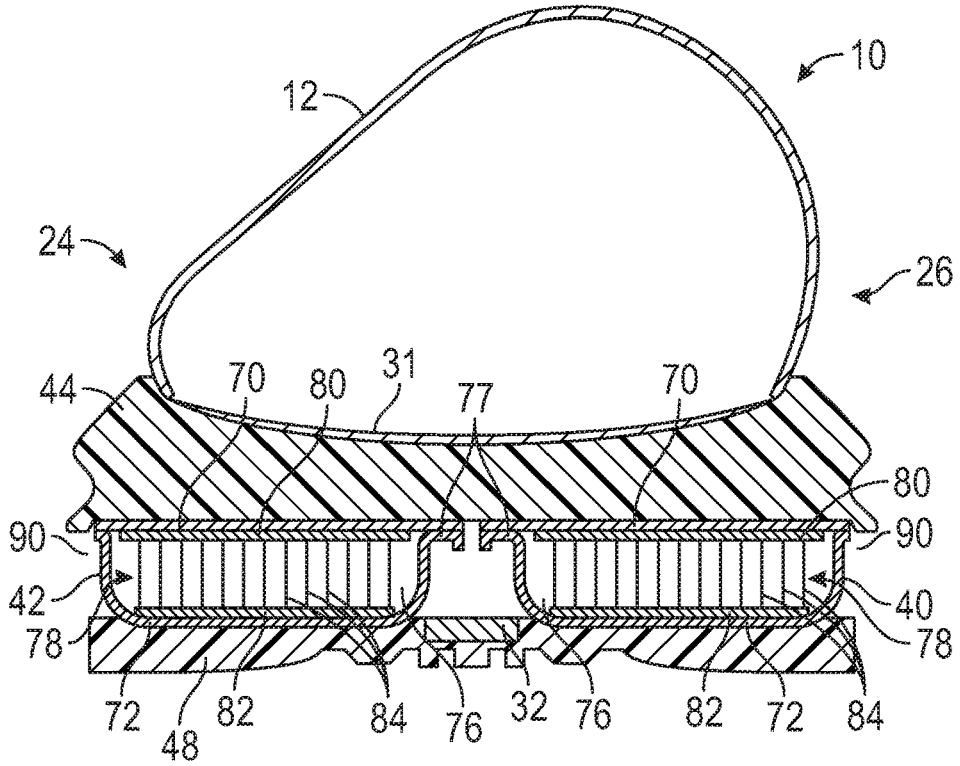
FIG. 8 is a cross-sectional view of the article of footwear taken at lines 8-8 in FIG. 4.

As best shown in FIGS. 7 and 8, each of the lateral forefoot cushioning unit 40, the medial forefoot cushioning unit 42, the first heel cushioning unit 36, and the second heel cushioning unit 38 includes a respective first polymeric sheet 70 (also referred to as upper polymeric sheet 70) and second polymeric sheet 72 (also referred to as lower polymeric sheet 72) bonded to one another at a peripheral flange 74 to create a sealed interior cavity 76 that retains a fluid, such as air. For each of the lateral forefoot cushioning unit 40, the medial forefoot cushioning unit 42, and the second heel cushioning unit 38, the peripheral flange 74 is offset towards the top of the unit so that the lower polymeric sheet 72 forms sidewalls of the cushioning unit. The first heel cushioning unit 36, however, has the peripheral flange 74 offset toward the bottom of the unit so that the upper polymeric sheet 70 forms sidewalls of the first heel cushioning unit 36. Inflation ports 77 are sealed and disposed in a forward direction on the heel cushioning units 36, 38. In this manner, the first and second heel cushioning units 36, 38 are not only vertically stacked, they are mirror images of one another if viewed as reflected across the first plate 32. The same portions of each of the first and second heel cushioning units 36, 38 interface with opposite sides of the first plate 32. The second polymeric sheet 72 of the first heel cushioning unit 36 and the first polymeric sheet 70 of the second heel cushioning unit 38 are relatively flat in comparison to the corresponding first polymeric sheet 70 of the first heel cushioning unit 36 and second polymeric sheet 72 of the second heel cushioning unit 38. Placing the first and second heel cushioning units 36, 38 with the relatively flat sheets away from the first plate 32 (e.g., closer to the outsole 48 and the cushioning layer 44, respectively, increases the stability of the sole structure in comparison to placing the flatter sheets against the first plate 32.

As shown in FIG. 8, each of the forefoot cushioning units 40, 42 is arranged as mirror images of one another if viewed as reflected across a longitudinal axis extending between the forefoot cushioning units 40, 42. Inflation ports 77 of the forefoot cushioning units 40, 42 are sealed and disposed inward, between the cushioning units 40, 42.

The proximal side of each of the lateral forefoot cushioning unit 40, the medial forefoot cushioning unit 42, and the second heel cushioning unit 38 is the upper surface of the upper polymeric sheet 70 and is bonded to the distal side 79 of the cushioning layer 44. The proximal side of the first heel cushioning unit 36 is the upper surface of the upper polymeric sheet 70 and is bonded to the distal side 52 of the first plate 32. The distal side of each of the lateral forefoot cushioning unit 40 and the medial forefoot cushioning unit 42 is the lower surface of the lower polymeric sheet 72 and is bonded to the proximal side 45 of the outsole 48. The distal side of the first heel cushioning unit 36 is the lower surface of the lower polymeric sheet 72 and is bonded to the proximal side 56 of the second plate 34. The distal side of the second heel cushioning unit 36 is the lower polymeric sheet 72 and is bonded to the proximal side of the first plate 32. Bonding of the lateral forefoot cushioning unit 40, the medial forefoot cushioning unit 42, the first heel cushioning unit 36, and the second heel cushioning unit 38 to the respective components that they contact (e.g., the outsole 48, the cushioning layer 44, the first plate 32, or the second plate 34) may be by thermal bonding or adhesive.

The upper and lower polymeric sheets 70, 72 can be a variety of polymeric materials that can resiliently retain a fluid such as nitrogen, air, or another gas. Examples of polymeric materials for the upper and lower polymeric sheets 70, 72 include thermoplastic urethane, polyurethane, polyester, polyester polyurethane, and polyether polyurethane. Moreover, the upper and lower polymeric sheets 70, 72 can each be formed of layers of different materials including polymeric materials. In one embodiment, each of the upper and lower polymeric sheets 70, 72 is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the upper and lower polymeric sheets 70, 72 are disclosed in U.S. Pat. Nos. 4,183,156 and 4,219,945 to Rudy which are incorporated by reference in their entireties. Further suitable materials for the upper and lower polymeric sheets 70, 72 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for those ones of the lateral forefoot cushioning unit 40, the medial forefoot cushioning unit 42, the first heel cushioning unit 36, and the second heel cushioning unit 38 that are fluid-filled bladders, engineering properties such as tensile strength, stretch properties, fatigue characteristics, dynamic modulus, and loss tangent can be considered. For example, the thicknesses of the upper and lower polymeric sheets 70, 72 used to form the fluid-filled bladder can be selected to provide these characteristics.

As best shown in FIGS. 7 and 8, each of the lateral forefoot cushioning unit 40, the medial forefoot cushioning unit 42, the first heel cushioning unit 36, and the second heel cushioning unit 38 configured as a fluid-filled bladder includes a tensile component 78 disposed in the interior cavity 76. The tensile component 78 includes a first tensile layer 80, a second tensile layer 82, and a plurality of tethers 84 spanning the interior cavity 76 from the first tensile layer 80 to the second tensile layer 82. The tethers 84 connect the first tensile layer 80 to the second tensile layer 82. Only some of the tethers 84 are indicated with reference numbers in FIGS. 7 and 8. The tethers 84 may also be referred to as fabric tensile members or threads and may be in the form of drop threads that connect the first tensile layer 80 and the second tensile layer 82. The tensile component 78 may be formed as a unitary, one-piece textile element having a spacer-knit textile (i.e., the tensile layers 80, 82 and the tethers 84 knit as one piece). The first tensile layer 80 is bonded to an upper interior surface of the respective cushioning component at the upper polymeric sheet 70, and the second tensile layer 82 is bonded to a lower interior surface of the respective cushioning component at the lower polymeric sheet 72.

The tethers 84 restrain separation of the upper and lower polymeric sheets 70, 72 to the maximum separated positions shown in FIGS. 7 and 8 under a given inflation pressure of gas in the interior cavity 76. Notably, the interior cavity 76 of each of the lateral forefoot cushioning unit 40, the medial forefoot cushioning unit 42, the first heel cushioning unit 36, and the second heel cushioning unit 38 is isolated from the interior cavity of each other one of the lateral forefoot cushioning unit 40, the medial forefoot cushioning unit 42, the first heel cushioning unit 36, and the second heel cushioning unit 38, and so each may be inflated to a different pressure. The outward force of pressurized gas in the interior cavity 76 places the tethers 84 in tension, and the tethers 84 prevent the tensile layers 80, 82 and polymeric sheets 70, 72 from further movement away from one another in the vertical direction in FIGS. 7 and 8. However, the tethers 84 do not present resistance to compression when under a compressive load. When pressure is exerted on any or all of lateral forefoot cushioning unit 40, the medial forefoot cushioning unit 42, the first heel cushioning unit 36 or the second heel cushioning unit 38 such as due to a force of a dynamic impact of a wearer during running or other movements, or during longitudinal bending of the sole structure 14, the lateral forefoot cushioning unit 40, the medial forefoot cushioning unit 42, and/or the first and second heel cushioning units 36, 38 is compressed, and the polymeric sheets 70, 72 move closer together with the tethers 84 collapsing (i.e., going slack) in proportion to the pressure exerted on the upper and lower polymeric sheets 70, 72 adjacent the particular tethers 84.

The portions of the first and second plates 32, 34 or of the cushioning layer 44 or the outsole 48 that are secured to the respective lateral forefoot cushioning unit 40, medial forefoot cushioning unit 42, and/or first and second heel cushioning units 36, 38 are generally flat. The distal side 79 of the cushioning layer 44 to which the first and second forefoot cushioning units 40, 42 are secured is spaced apart by a substantially uniform distance from the proximal side 45 of the outsole 48 to which the first and second forefoot cushioning units 40, 42 are secured when in the unstressed state shown in FIGS. 7 and 8, for example. Similarly, the distal side 52 of the first plate 32 that is secured to the first heel cushioning unit 36 is spaced apart by a substantially uniform distance from the proximal side 56 of the second plate 34 to which the first heel cushioning unit 36 is secured, and the proximal side 88 of the first plate 32 that is secured to the second heel cushioning unit 38 is spaced apart by a substantially uniform distance from the distal side 79 of the cushioning layer 44 to which the second heel cushioning unit 38 is secured when in the unstressed state shown in FIGS. 7 and 8, for example. Even localized impact forces are dispersed by the plates 32, 34 to act more uniformly over the respective heel cushioning units 36, 38. For example, a localized force on the proximal side of the first heel cushioning unit 36 is dispersed downward over the entire first heel cushioning unit 36 by the plate 32, which compresses the first heel cushioning unit 36 as a unit across its width, rather than compressing a localized portion of the first heel cushioning unit 36. This generally allows all of the tethers 84 to grow slack and return to their tensioned state in unison, rather than causing one or more localized groups of tethers to slacken and tension differently than surrounding tethers, as may occur when a fluid-filled bladder is compressed under loading by a foot without plates above and below the fluid-filled bladder.

Referring to FIGS. 1, 2, and 7, the cushioning layer 44 is a one-piece component that extends from the forefoot region 18 to the heel region 22 and contacts the proximal side 88 of the first plate 32 at a front of the first plate 32 in the forefoot region 18 and at the midfoot region 20. The portion of the cushioning layer 44 contacting the first plate 32 forward of the forefoot cushioning units 40, 42 may be referred to as a front post 44E. The portion of cushioning layer 44 contacting the first plate 32 between the forefoot cushioning units 40, 42 and the heel cushioning units 36, 38 may be referred to as a midfoot post 44F. The stacked components result in a relatively high height of the sole structure 14, and the front post 44E and midfoot post 44F lend stability to the sole structure 14 by providing a direct path for load transfer through the cushioning layer to the first plate 32 and minimizing side-to-side shifting or twisting of the cushioning layer 44 relative to the outsole when the outsole 48 is planted on the ground. The cushioning layer 44 defines a forefoot gap 90 at a distal side 79 of the cushioning layer 44 between the front portion 32A of the first plate 32 in the forefoot region 18 and the midfoot region 20 (e.g., between the front post 44E and the midfoot post 44F). The cushioning layer 44 also defines a second heel gap 92 at the distal side 79 of the cushioning layer 44 rearward of the midfoot region 20 (e.g., rearward of the midfoot post 44F). The first heel gap 54, the second heel gap 92, and the forefoot gap 90 all extend completely through the article of footwear 10 from the lateral side 24 to the medial side 26. The forefoot cushioning units 40, 42 are both disposed in the forefoot gap 90. The first heel cushioning unit 36 is disposed in the first heel gap 54, and the second heel cushioning unit 38 is disposed in the second heel gap 92. As best seen in FIG. 7, the cushioning layer 44 is thickest at the front post 44E and the midfoot post 44F. The portion of the cushioning layer 44 overlying the two forefoot cushioning units 40, 42 is thicker than the portion of the cushioning layer 44 overlying the second heel cushioning unit 38. Accordingly, the cushioning effect of the cushioning layer 44 is greater in the forefoot region 18 than in the heel region 22.

FIG. 7 shows the rear segment 46A of the peripheral heel clip 46 contacting a rear wall 44C of the cushioning layer 44 and supported on the ledge 32D of the rear portion 32C of the first plate 32. As shown, the rear segment 46A cups the cushioning layer 44 by wrapping partially under the cushioning layer 44 from a rear wall 46D of the rear segment 46A and extending forward above the first and second heel through holes 64, 66. The heel clip 46 covers a portion of the outsole layer 48, protecting it from dirt and dust. The relatively harder heel clip 46 may have a smoother outer surface that is easier to clean that the outsole layer 48.

Figure 9:
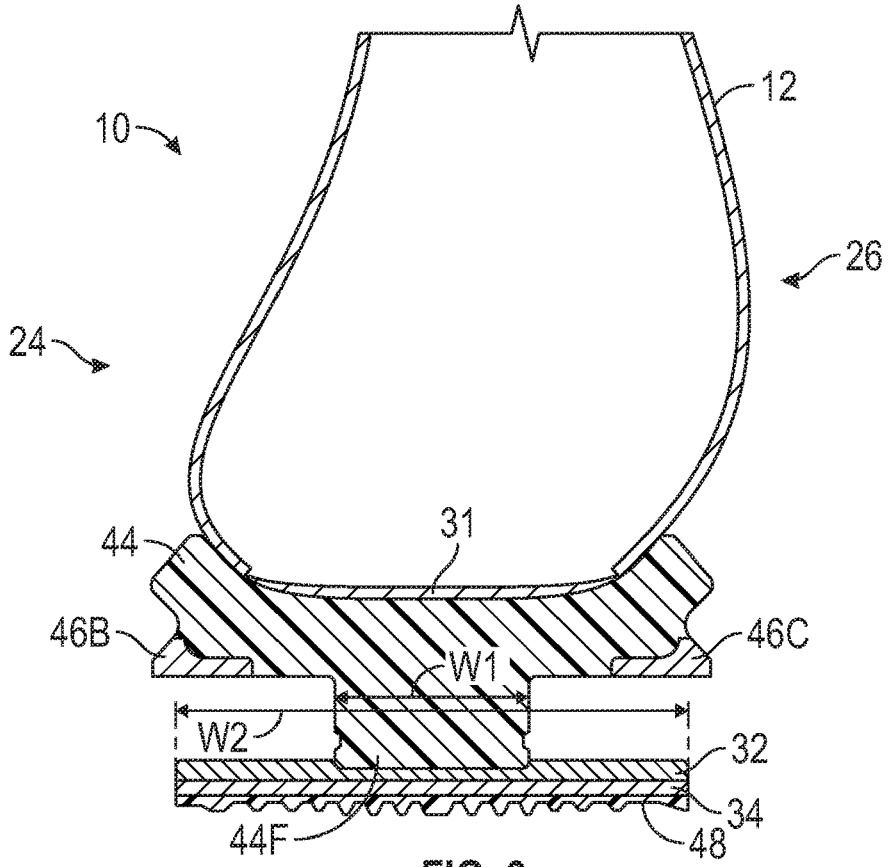
FIG. 9 is a cross-sectional view of the article of footwear taken at lines 9-9 in FIG. 4.

FIG. 8 shows the lateral and medial forefoot cushioning units 40, 42 disposed side-by-side in the forefoot gap 90. FIG. 9 shows that the medial segment 46C and the lateral segment 46B of the peripheral heel clip 46 are spaced apart from the first plate 32 (e.g., not in contact with the first plate 32). FIG. 9 also shows that the midfoot post 44F of the cushioning layer 44 has a width W1 less than the width W2 of the first plate 32 at the location of the first plate 32 on which it is supported.

Figure 10:
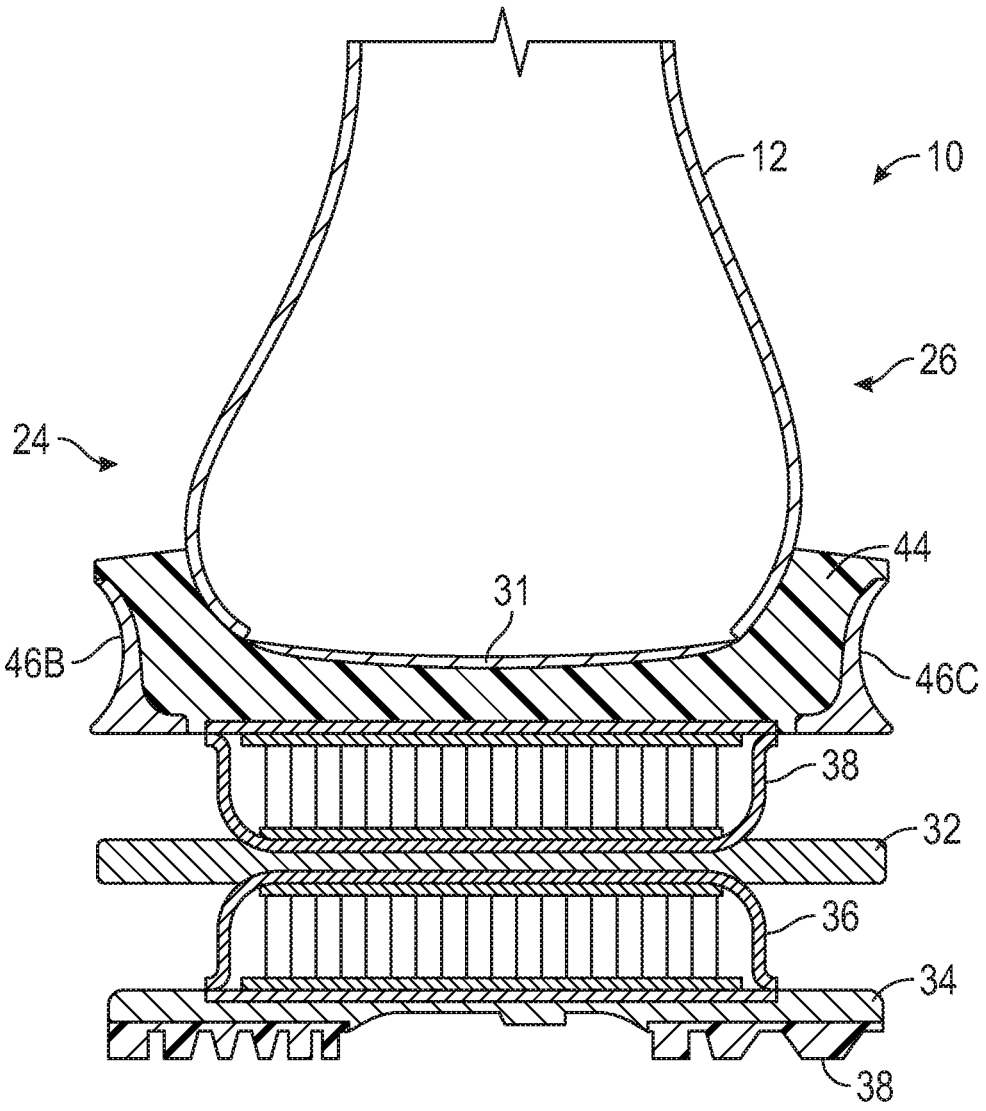
FIG. 10 is a cross-sectional view of the article of footwear taken at lines 10-10 in FIG. 4 with the upper in fragmentary view.

FIG. 10 shows the first and second heel cushioning units 36, 38 stacked in alignment with one another, and the lateral segment 46B and the medial segment 46C of the peripheral heel clip 46 spaced apart from (e.g., not in contact with) the first plate 32. As is most evident in FIG. 10, both of the lateral segment 46B and the medial segment 46C are bowed inward (e.g., are slightly concave at their outer side surfaces and slightly convex at their inner side surfaces). This bowed shape may help constrain outward deflection of the cushioning layer 44 under compression during dynamic loading and may instead direct more of the energy of the dynamic load downward onto the stacked heel cushioning units 36, 38 than if lateral and medial segments with flat outer and inner surfaces were used.

Figure 11:
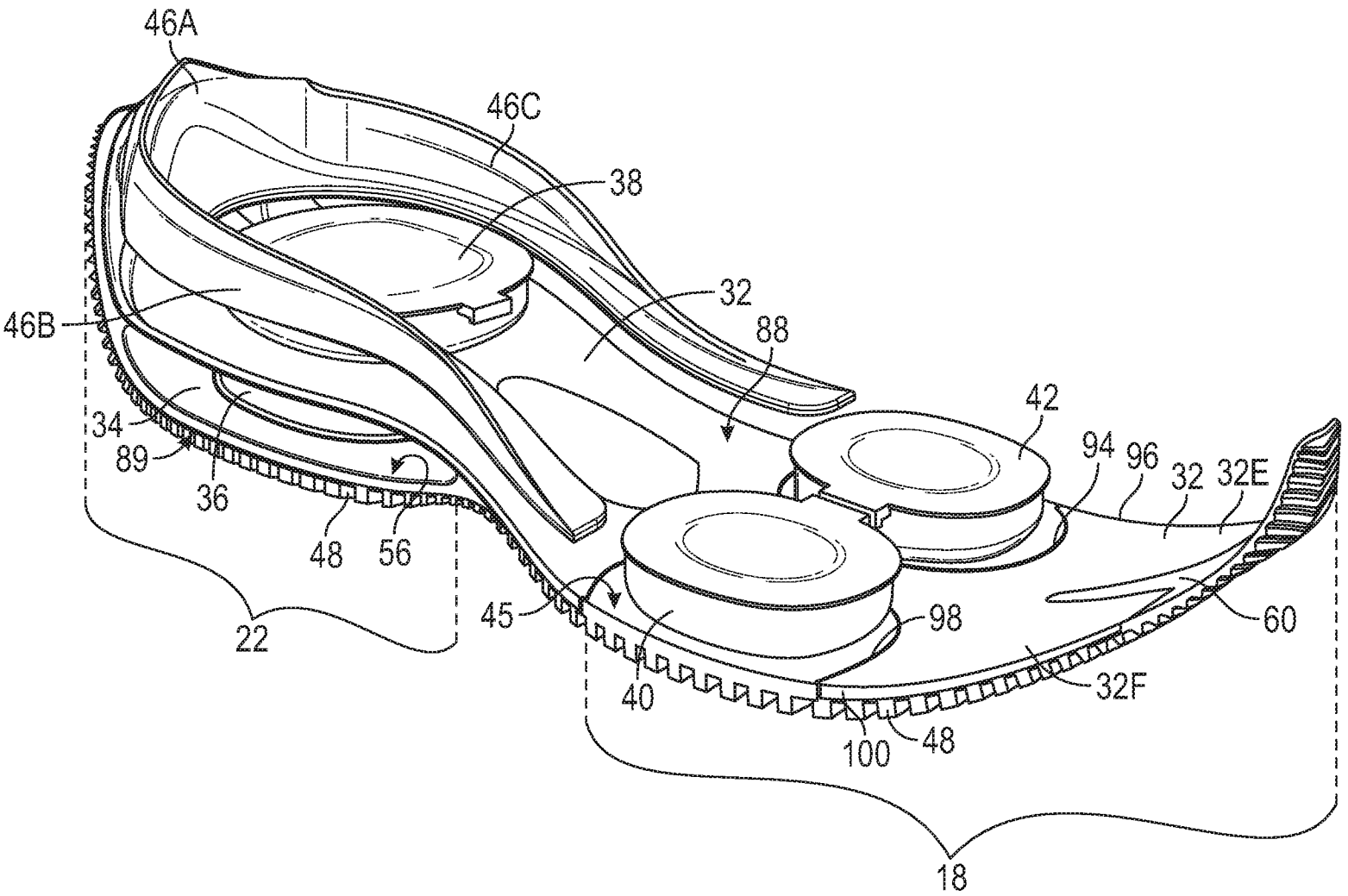
FIG. 11 is a perspective view of the sole structure with the upper and a cushioning layer not shown.

FIG. 11 shows the relative positions of the first plate 32, the second plate 34, the peripheral heel clip 46, the outsole 48 and the cushioning units 36, 38, 40, and 42, with the cushioning layer 44 and the upper 12 not shown for clarity. As in FIG. 10, the lateral segment 46B and the medial segment 46C of the peripheral heel clip 46 extend forward from the rear segment 46A and are spaced apart from (e.g., not in contact with) the first plate 32.

FIG. 11 shows that the first plate 32 has a medial notch 94 in a medial edge 96 of the first plate in the forefoot region 18 and a lateral notch 98 in a lateral edge 100 of the first plate 32 in the forefoot region 18. The notches 94, 98 decrease the width of the first plate 32 at the notches. The narrower portion of the first plate 32 at the notches 94, 98 decreases the bending stiffness of the first plate at the notches 94, 98 during dorsiflexion. As the notches 94, 98 may generally align with the metatarsal phalangeal joints of the wearer, this may decrease the overall bending stiffness of the sole structure during dorsiflexion in comparison to a sole structure like sole structure 14 but without the notches 94, 98 (e.g., with a full-width first plate at the metatarsal phalangeal joints). The notches 94, 98 may also increase medial-lateral flexibility in the forefoot region 18. The bifurcation of the first plate 32 forward of the medial notch 94 and the lateral notch 98 is shown with the medial and lateral projections 32E, 32F separated by the slot 60, further increasing forefoot flexibility, such as by increasing the ability of a wearer to cut in a medial-lateral direction (e.g., sideways). The outsole 48 extends under and in the medial notch 94 and the lateral notch 98 as well as the slot 60. As shown in FIGS. 7 and 11, the outsole 48 fills the notches 94, 98 so that the proximal side 45 of the outsole 48 in the notches 94, 98 is flush with the proximal side 88 of the first plate 32.

The medial forefoot cushioning unit 42 is disposed at the medial notch 94 on the outsole 48 (e.g., with a distal side of the medial forefoot cushioning unit 42 contacting the proximal side 45 of the outsole 48). The lateral forefoot cushioning unit 40 is disposed at the lateral notch 98 alongside with medial forefoot cushioning unit 42 (e.g., with the distal side of the lateral forefoot cushioning unit 40 contacting the proximal side 45 of the outsole 48). The outsole 48 may be less stiff and not as hard as the first plate 32. By disposing the forefoot cushioning units at the notches 94, 98 so that they rest on and contact the outsole 48 rather than the first plate 32, the leveling and force dispersing (e.g., spreading) effect of the relatively stiff first plate 32 does not affect the forefoot cushioning units 40, 42 as it does the heel cushioning units 36, 38. Instead, the less stiff and more compressible cushioning layer 44 overlies and contacts the cushioning units 40, 42. The forefoot cushioning units 40, 42 are thus generally able to react separately to localized dynamic compression according to their individual cushioning responses tailored (e.g., with the medial forefoot cushioning unit 42 reacting dynamic compressive forces that are at the medial side of the longitudinal midline and the lateral forefoot cushioning unit 40 reacting dynamic compressive forces that are at the lateral side of the longitudinal midline LM). The outsole 48 is shown extending from the forefoot region 18 to the heel region 22 and disposed at and contacting the distal side 89 of the second plate 34 in the heel region 22.

Figure 12:
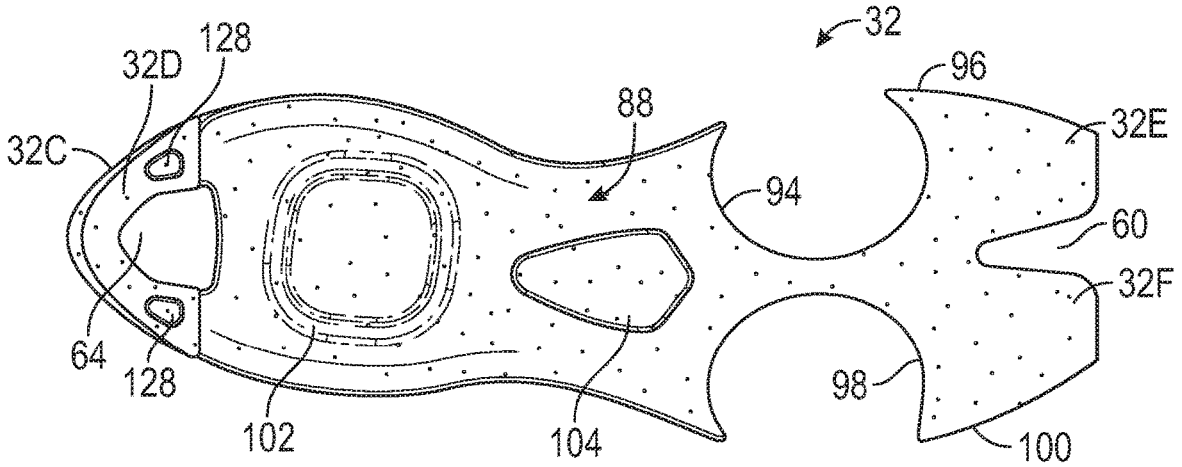
FIG. 12 is a top view of a first plate of the plate assembly of FIG. 3.
Figure 13:
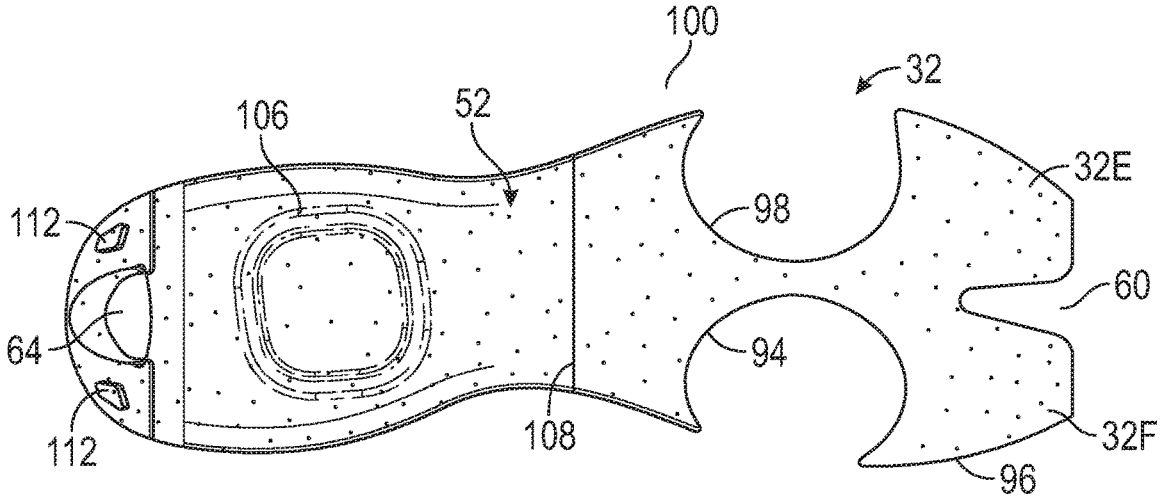
FIG. 13 is a bottom view of the first plate.

FIGS. 12 and 13 show the proximal (top) side 88 and the distal (bottom) side 52 of the first plate 32, respectively. The ledge 32D for the heel clip 46 is shown surrounding the first heel through hole 64. A slight depression 102 in the proximal side 88 of the first plate 32 may serve as a positioning marker (e.g., a locating feature) for the second heel cushioning unit 38 to facilitate a simple and accurate assembly process. Similarly, another slight depression 104 may serve as a positioning marker for the midfoot post 44F of the cushioning layer 44. FIG. 12 shows a slight depression 106 in the distal side 52 of the first plate 32 that may serve as a positioning marker for the first heel cushioning unit 36. The distal side 52 has an edge 108 at which the first plate has a change in slope (e.g., ascending rearward of the edge 108). The edge 108 serves as a marker against which a forward edge 110 of the second plate 34 (see FIG. 14) can be abutted during manufacturing to accurately locate the second plate 34 relative to the first plate 32. The distal side 52 of the first plate 32 has protrusion 112 on either side of the first heel through hole 64.

Figure 14:
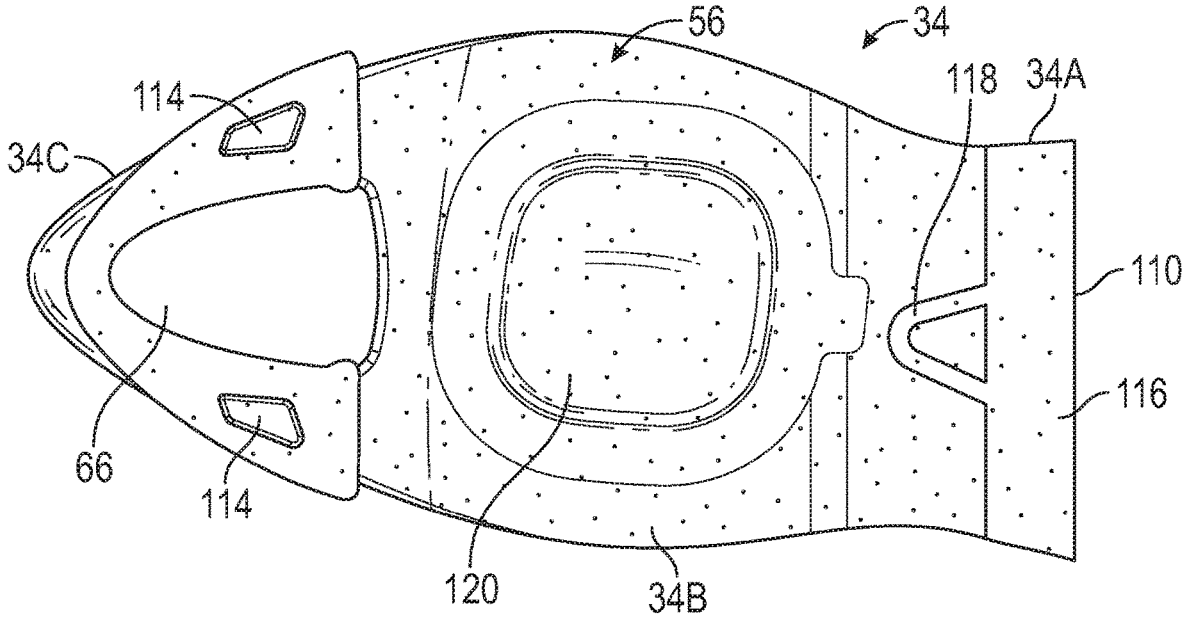
FIG. 14 is a top view of a second plate of the plate assembly of FIG. 3.

As shown in FIG. 14, the proximal side 56 of the second plate 34 has slight recessions 114 shaped like the protrusions 112 and spaced apart from one another by the same distance as the protrusions 112. The protrusions 112 and recessions 114 serve as positioning markers to properly locate the rear portion 32C of the first plate 32 relative to the rear portion 34C of the second plate 34 during manufacturing of the tiered plated assembly 17.

FIG. 14 also shows that the proximal side 56 of the second plate 34 at the forward portion 34A of the second plate 34 has a relatively flat bonding region 116 extending rearward from the forward edge 110. The bonding region 116 slopes slightly upward (while still being flat, e.g., at a constant slope) to the rear of a central post 118. The bonding region 116 and central post 118 interface with and bond to the distal side 52 of the first plate 32. The central post 118 is also indicated in FIGS. 1 and 3.

Figure 15:
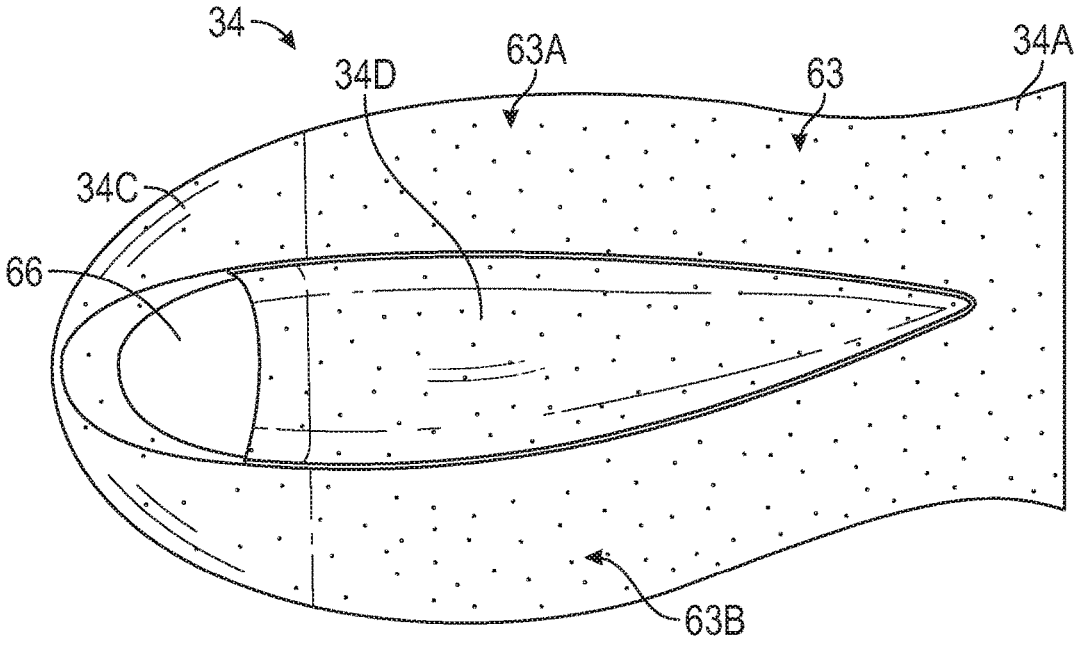
FIG. 15 is a bottom view of the second plate.

The proximal side 56 of the second plate 34 also has a slight depression 120 that may serve as a positioning marker for the first heel cushioning unit 36. The recess 34D in the distal side 63 of the second plate 34 is also shown in FIG. 15. The distal side 63 has a lateral portion 63A at a lateral side of the recess 34D at which the lateral side portion 48A of the outsole 48 is bonded in FIG. 5, and a medial portion 63B at a medial side of the recess 34D at which the medial side portion 48B is bonded in FIG. 5.

Figure 16:
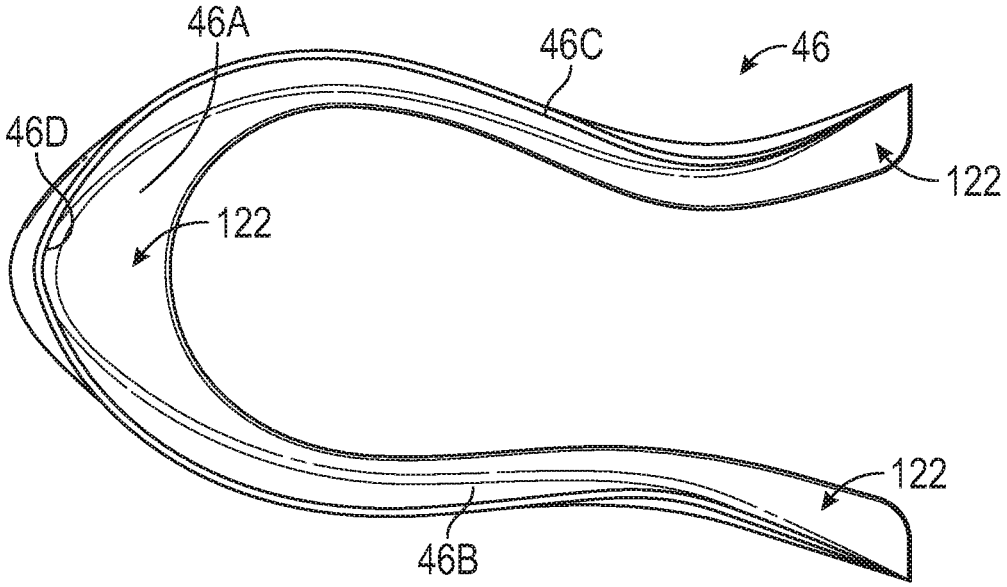
FIG. 16 is a top view of a peripheral heel clip of the sole structure of FIG. 1.
Figure 17:
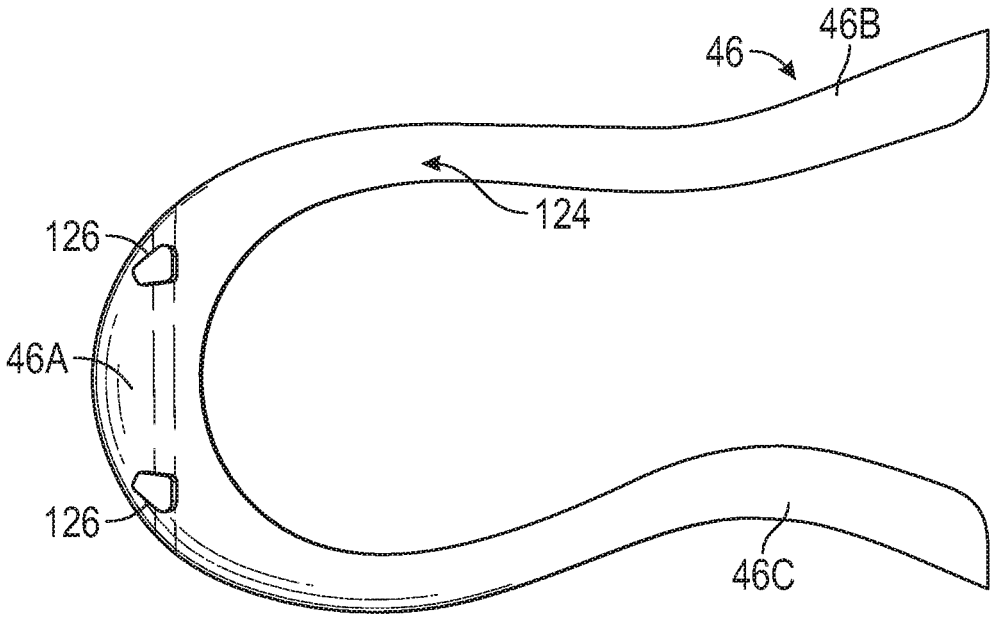
FIG. 17 is a bottom view of the peripheral heel clip.

FIG. 16 shows the peripheral heel clip 46 including the rear wall 46D and the rear segment 46A extending forward from the rear wall 46D to support and cup the cushioning layer 44 as in FIG. 7. In fact, the peripheral heel clip 46 has a proximal side 122 that extends in each of the rear segment 46A, the lateral segment 46B and the medial segment 46C to support the distal side 79 of the cushioning layer 44 that interfaces with the heel clip 46. As shown in FIG. 17, a distal side 124 of the peripheral heel clip 46 has slight protrusions 126 spaced apart from one another by the same distance as slight recessions 128 in the proximal side 88 of the first plate 32 (see FIG. 12). The protrusions 126 are the same shape as the recessions 128 and fit into the recession 128 during assembly. The protrusions 126 and recessions 128 serve as positioning markers to quickly and accurately locate the peripheral heel clip 46 relative to the first plate 32 during manufacturing of the sole structure 14.

The following clauses provide example configurations of a sole structure and an article of footwear disclosed herein.

Clause 1. A sole structure comprising: a tiered plate assembly including a first plate and a second plate; the first plate extending from a forefoot region of the sole structure to a heel region of the sole structure; the second plate joined with the first plate in a midfoot region of the sole structure and at a rear of a heel region of the sole structure, and diverging from the first plate between the midfoot region and the rear of the heel region to define a first heel gap between the first plate and the second plate in the heel region.

Clause 2. The sole structure of clause 1, further comprising: a first heel cushioning unit disposed in the first heel gap and confronting a distal side of the first plate and a proximal side of the second plate; and a second heel cushioning unit stacked on the proximal side of the first plate in the heel region and opposite from the first heel cushioning unit.

Clause 3. The sole structure of clause 2, wherein the first heel cushioning unit and the second heel cushioning unit are fluid-filled bladders.

Clause 4. The sole structure of clause 1, wherein a rear portion of the first plate and the rear portion of the second plate ascend together in a proximal direction at the rear of the heel region.

Clause 5. The sole structure of clause 4, wherein the rear portion of the first plate has a ledge; and the sole structure further comprising: a peripheral heel clip having a rear segment, a medial segment, and a lateral segment, with the rear segment supported on the ledge, the medial segment extending forward from the rear segment along a medial side of the sole structure, and the lateral segment extending forward from the rear segment along a lateral side of the sole structure.

Clause 6. The sole structure of any of clauses 1-5, wherein a rear portion of the first plate defines a first heel through hole and the rear portion of the second plate defines a second heel through hole in communication with the first heel through hole.

Clause 7. The sole structure of any of clauses 1-6, wherein the first plate has a medial notch in a medial edge of the first plate in the forefoot region and a lateral notch in a lateral edge of the first plate in the forefoot region.

Clause 8. The sole structure of clause 7, wherein the first plate is bifurcated forward of the medial notch and the lateral notch.

Clause 9. The sole structure of clause 7, further comprising: a medial forefoot cushioning unit disposed at the medial notch; and a lateral forefoot cushioning unit disposed at the lateral notch alongside with medial forefoot cushioning unit.

Clause 10. The sole structure of clause 9, wherein the medial forefoot cushioning unit and the lateral forefoot cushioning unit are fluid-filled bladders.

Clause 11. The sole structure of clause 9, further comprising: an outsole disposed at a distal side of the first plate in the forefoot region; and wherein a distal side of the medial forefoot cushioning unit and a distal side of the lateral forefoot cushioning unit confront the outsole.

Clause 12. The sole structure of clause 11, wherein the outsole extends from the forefoot region to the heel region and is disposed at a distal side of the second plate in the heel region.

Clause 13. The sole structure of any of clauses 1-12, further comprising: a cushioning layer extending from the forefoot region to the heel region and confronting a proximal side of the first plate at a front of the first plate in the forefoot region and at the midfoot region, the cushioning layer defining a forefoot gap at a distal side of the cushioning layer between the front of the forefoot region and the midfoot region and defining a second heel gap at the distal side of the cushioning layer rearward of the midfoot region.

Clause 14. The sole structure of clause 13, further comprising: at least one forefoot cushioning unit disposed in the forefoot gap; and a heel cushioning unit disposed in the second heel gap.

Clause 15. The sole structure of clause 13, further comprising: a peripheral heel clip having a rear segment confronting a rear wall of the cushioning layer and supported on a rear portion of the first plate, a medial segment extending forward from the rear segment along a medial side wall of the cushioning layer, and a lateral segment extending forward from the rear segment along a lateral side wall of the cushioning layer.

Clause 16. An article of footwear comprising: an upper; and a sole structure coupled to the upper, the sole structure including: a tiered plate assembly including a first plate and a second plate; the first plate extending from a forefoot region of the sole structure to a heel region of the sole structure; the second plate having a forward portion joined with the first plate in a midfoot region of the sole structure, a rear portion joined with the first plate at a rear of a heel region of the sole structure, and a midportion diverging from the first plate between the forward portion and the rear portion to define a first heel gap between a distal side of the first plate and a proximal side of the second plate in the heel region.

Clause 17. The article of footwear of clause 16, wherein the sole structure further comprises: a cushioning layer extending from the forefoot region and confronting the proximal side of the first plate at a front of the first plate in the forefoot region and at the midfoot region, the cushioning layer defining a forefoot gap at a distal side of the cushioning layer between the front of the forefoot region and the midfoot region, and defining a second heel gap at the distal side of the cushioning layer rearward of the midfoot region.

Clause 18. The article of footwear of clause 17, further comprising: at least one forefoot cushioning unit disposed in the forefoot gap; a first heel cushioning unit disposed in the first heel gap on the proximal side of the second plate and confronting the distal side of the first plate; and a second heel cushioning unit disposed in the second heel gap on the proximal side of the second plate opposite from the first heel cushioning unit and confronting the distal side of the cushioning layer.

Clause 19. The article of footwear of clause 17, wherein a rear portion of the first plate defines a first heel through hole and the rear portion of the second plate defines a second heel through hole; and wherein the rear portion of the first plate and the rear portion of the second plate ascend together in a proximal direction at the rear of the heel region such that the first heel through hole and the second heel through hole are exposed from rearward of the heel region.

Clause 20. The article of footwear of any of clauses 17-19, further comprising: a peripheral heel clip having a rear segment, a medial segment, and a lateral segment, the rear segment confronting a rear wall of the cushioning layer and supported on a rear portion of the first plate, the medial segment extending forward from the rear segment along a medial side wall of the cushioning layer, and the lateral segment extending forward from the rear segment along a lateral side wall of the cushioning layer.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A sole structure comprising:

a tiered plate assembly including a first plate and a second plate;

the first plate extending from a forefoot region of the sole structure to a heel region of the sole structure;

the second plate directly joined with the first plate in a midfoot region of the sole structure and at a rear of a heel region of the sole structure, and diverging from the first plate between the midfoot region and the rear of the heel region to define a first heel gap between the first plate and the second plate in the heel region; and wherein a rear portion of the first plate and the rear portion of the second plate ascend together in a proximal direction at the rear of the heel region.

2. The sole structure of claim 1, further comprising:

a first heel cushioning unit disposed in the first heel gap and contacting a distal side of the first plate and a proximal side of the second plate; and a second heel cushioning unit stacked on the proximal side of the first plate in the heel region and opposite from the first heel cushioning unit.

3. The sole structure of claim 2, wherein the first heel cushioning unit and the second heel cushioning unit are fluid-filled bladders.

4. The sole structure of claim 1, further comprising:

a cushioning layer extending from the forefoot region to the heel region and contacting a proximal side of the first plate at a front of the first plate in the forefoot region and at the midfoot region, the cushioning layer defining a forefoot gap at a distal side of the cushioning layer between the front of the forefoot region and the midfoot region and defining a second heel gap at the distal side of the cushioning layer rearward of the midfoot region.

5. The sole structure of claim 4, further comprising:

at least one forefoot cushioning unit disposed in the forefoot gap; and a heel cushioning unit disposed in the second heel gap.

6. A sole structure comprising:

a tiered plate assembly including a first plate and a second plate;

the first plate extending from a forefoot region of the sole structure to a heel region of the sole structure; wherein a rear portion of the first plate has a ledge;

the second plate directly joined with the first plate in a midfoot region of the sole structure and at a rear of a heel region of the sole structure, and diverging from the first plate between the midfoot region and the rear of the heel region to define a first heel gap between the first plate and the second plate in the heel region; and a peripheral heel clip disposed above a proximal side of the first plate and having a rear segment, a medial segment, and a lateral segment, with the rear segment supported on the ledge, the medial segment extending forward from the rear segment along a medial side of the sole structure and spaced apart from the first plate, and the lateral segment extending forward from the rear segment along a lateral side of the sole structure and spaced apart from the first plate.

7. A sole structure comprising:

a tiered plate assembly including a first plate and a second plate;

the first plate extending from a forefoot region of the sole structure to a heel region of the sole structure;

the second plate directly joined with the first plate in a midfoot region of the sole structure and at a rear of a heel region of the sole structure, and diverging from the first plate between the midfoot region and the rear of the heel region to define a first heel gap between the first plate and the second plate in the heel region; and wherein a rear portion of the first plate defines a first heel through hole and the rear portion of the second plate defines a second heel through hole in communication with the first heel through hole.

8. A sole structure comprising:

a tiered plate assembly including a first plate and a second plate;

the first plate extending from a forefoot region of the sole structure to a heel region of the sole structure;

the second plate directly joined with the first plate in a midfoot region of the sole structure and at a rear of a heel region of the sole structure, and diverging from the first plate between the midfoot region and the rear of the heel region to define a first heel gap between the first plate and the second plate in the heel region; and wherein the first plate has a medial notch in a medial edge of the first plate in the forefoot region and a lateral notch in a lateral edge of the first plate in the forefoot region.

9. The sole structure of claim 8, wherein the first plate is bifurcated forward of the medial notch and the lateral notch.

10. The sole structure of claim 8, further comprising:

a medial forefoot cushioning unit disposed at the medial notch; and a lateral forefoot cushioning unit disposed at the lateral notch alongside with medial forefoot cushioning unit.

11. The sole structure of claim 10, wherein the medial forefoot cushioning unit and the lateral forefoot cushioning unit are fluid-filled bladders.

12. The sole structure of claim 10, further comprising:

an outsole disposed at a distal side of the first plate in the forefoot region; and wherein a distal side of the medial forefoot cushioning unit and a distal side of the lateral forefoot cushioning unit contact the outsole.

13. The sole structure of claim 12, wherein the outsole extends from the forefoot region to the heel region and is disposed at a distal side of the second plate in the heel region.

14. A sole structure comprising:

a tiered plate assembly including a first plate and a second plate;

the first plate extending from a forefoot region of the sole structure to a heel region of the sole structure;

the second plate directly joined with the first plate in a midfoot region of the sole structure and at a rear of a heel region of the sole structure, and diverging from the first plate between the midfoot region and the rear of the heel region to define a first heel gap between the first plate and the second plate in the heel region;

a cushioning layer extending from the forefoot region to the heel region and contacting a proximal side of the first plate at a front of the first plate in the forefoot region and at the midfoot region, the cushioning layer defining a forefoot gap at a distal side of the cushioning layer between the front of the forefoot region and the midfoot region and defining a second heel gap at the distal side of the cushioning layer rearward of the midfoot region; and a peripheral heel clip having a rear segment contacting a rear wall of the cushioning layer and supported on a rear portion of the first plate, a medial segment extending forward from the rear segment along a medial side wall of the cushioning layer and spaced apart from the first plate, and a lateral segment extending forward from the rear segment along a lateral side wall of the cushioning layer and spaced apart from the first plate.

15. An article of footwear comprising:

an upper; and a sole structure coupled to the upper, the sole structure including:

a tiered plate assembly including a first plate and a second plate;

the first plate being a one-piece, continuous plate and extending from a forefoot region of the sole structure to a heel region of the sole structure;

the second plate having a forward portion joined with the first plate in a midfoot region of the sole structure, a rear portion joined with the first plate at a rear of a heel region of the sole structure, and a midportion diverging from the first plate between the forward portion and the rear portion to define a first heel gap between a distal side of the first plate and a proximal side of the second plate in the heel region; and a cushioning layer extending from the forefoot region and contacting the proximal side of the first plate at a front of the first plate in the forefoot region and at the midfoot region, the cushioning layer defining a forefoot gap at a distal side of the cushioning layer between the front of the forefoot region and the midfoot region, and defining a second heel gap at the distal side of the cushioning layer rearward of the midfoot region;

wherein a rear portion of the first plate defines a first heel through hole and the rear portion of the second plate defines a second heel through hole; and wherein the rear portion of the first plate and the rear portion of the second plate ascend together in a proximal direction at the rear of the heel region such that the first heel through hole and the second heel through hole are exposed from rearward of the heel region.

16. The article of footwear of claim 15, further comprising:

at least one forefoot cushioning unit disposed in the forefoot gap;

a first heel cushioning unit disposed in the first heel gap on the proximal side of the second plate and contacting the distal side of the first plate; and a second heel cushioning unit disposed in the second heel gap on the proximal side of the second plate opposite from the first heel cushioning unit and contacting the distal side of the cushioning layer.

17. An article of footwear comprising:

an upper; and a sole structure coupled to the upper, the sole structure including:

a tiered plate assembly including a first plate and a second plate;

the first plate being a one-piece, continuous plate and extending from a forefoot region of the sole structure to a heel region of the sole structure;

the second plate having a forward portion joined with the first plate in a midfoot region of the sole structure, a rear portion joined with the first plate at a rear of a heel region of the sole structure, and a midportion diverging from the first plate between the forward portion and the rear portion to define a first heel gap between a distal side of the first plate and a proximal side of the second plate in the heel region;

a cushioning layer extending from the forefoot region and contacting the proximal side of the first plate at a front of the first plate in the forefoot region and at the midfoot region, the cushioning layer defining a forefoot gap at a distal side of the cushioning layer between the front of the forefoot region and the midfoot region, and defining a second heel gap at the distal side of the cushioning layer rearward of the midfoot region; and a peripheral heel clip having a rear segment, a medial segment, and a lateral segment, the rear segment contacting a rear wall of the cushioning layer, the medial segment extending forward from the rear segment along a medial side wall of the cushioning layer, and the lateral segment extending forward from the rear segment along a lateral side wall of the cushioning layer; wherein the medial segment has a concave outer side surface and a convex inner side surface; and wherein the lateral segment has a concave outer side surface and a convex inner side surface.

* * * * *